US007850368B2

(12) United States Patent
Pawloski et al.

(10) Patent No.: US 7,850,368 B2
(45) Date of Patent: Dec. 14, 2010

(54) CLOSURE DEVICE FOR A RECLOSABLE POUCH

(75) Inventors: James C. Pawloski, Bay City, MI (US); Douglas P. Gundlach, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 729 days.

(21) Appl. No.: 10/861,674

(22) Filed: Jun. 4, 2004

(65) Prior Publication Data

US 2005/0271307 A1 Dec. 8, 2005

(51) Int. Cl.
*B65D 33/16* (2006.01)

(52) U.S. Cl. ..... 383/61.2; 383/63; 24/585.1; 24/585.12

(58) Field of Classification Search ..... 383/61.2, 383/63; 24/585.1, 585.12
See application file for complete search history.

(56) References Cited

U.S. PATENT DOCUMENTS

| | | | | |
|---|---|---|---|---|
| 475,248 | A | 5/1892 | Pugsley | |
| 1,746,565 | A | 2/1930 | Sundback | |
| 1,959,318 | A | 5/1934 | Sundback | 24/205 |
| 2,354,485 | A | 7/1944 | Slaughter | 20/0.5 |
| 2,916,197 | A | 12/1959 | Detrie et al. | 229/56 |
| 3,038,225 | A | 6/1962 | Ausnit | 24/201 |
| 3,198,228 | A | 8/1965 | Naito et al. | 150/3 |
| 3,237,844 | A | 3/1966 | Hughes | 229/53 |
| 3,265,789 | A | 8/1966 | Hofer | 264/95 |
| 3,338,284 | A | 8/1967 | Ausnit | 150/3 |
| 3,338,285 | A | 8/1967 | Jaster | 150/3 |
| 3,340,116 | A | 9/1967 | Naito | 156/92 |
| 3,347,298 | A | 10/1967 | Ausnit et al. | 150/3 |
| 3,372,442 | A | 3/1968 | Ishimatsu | 24/201 |
| 3,410,327 | A | 11/1968 | Ausnit | 150/3 |
| 3,416,199 | A | 12/1968 | Imamura | 24/201 |
| 3,416,585 | A * | 12/1968 | Staller | 383/65 |
| 3,425,469 | A | 2/1969 | Ausnit | |
| 3,462,332 | A | 8/1969 | Goto | 156/244 |
| 3,528,600 | A | 9/1970 | White | 229/54 |
| 3,537,153 | A | 11/1970 | Ausnit | 24/201 |

(Continued)

FOREIGN PATENT DOCUMENTS

| | | | |
|---|---|---|---|
| CA | 764647 | 8/1967 | 24/45 |

(Continued)

OTHER PUBLICATIONS

Web page from www.zippak.com "One-Time Locking Zipper".

(Continued)

*Primary Examiner*—Nathan J Newhouse
*Assistant Examiner*—Peter Helvey

(57) ABSTRACT

A reclosable pouch comprises a body portion having first and second pouch walls. A first closure mechanism is disposed on internal sides of the first and second walls. The first closure mechanism includes a first female profile having first and second spaced legs and a first male profile. A second closure mechanism is disposed on the internal sides of the first and second pouch walls. The second closure mechanism includes a second female profile having third and fourth spaced legs and a second male profile. One of the first, second, third, or fourth spaced legs is longer than the other leg of the same female profile. Further, the first and second closure mechanisms comprise differing opening and closing characteristics.

26 Claims, 12 Drawing Sheets

U.S. PATENT DOCUMENTS

| | | | | |
|---|---|---|---|---|
| 3,565,147 | A | 2/1971 | Ausnit | 150/3 |
| 3,565,737 | A | 2/1971 | Lefevre et al. | 161/36 |
| RE27,174 | E | 9/1971 | Ausnit | 150/3 |
| 3,608,439 | A | 9/1971 | Ausnit | 93/35 R |
| 3,715,420 | A | 2/1973 | Kiyono et al. | 264/171 |
| 3,780,781 | A | 12/1973 | Uramoto | 150/3 |
| 3,827,472 | A | 8/1974 | Uramoto | 150/3 |
| 3,840,418 | A | 10/1974 | Sabee | 156/244 |
| 3,841,816 | A | 10/1974 | Herz | 425/326 |
| 3,937,395 | A | 2/1976 | Lawes | 229/62.5 |
| RE28,969 | E | 9/1976 | Naito | 150/3 |
| 4,046,408 | A | 9/1977 | Ausnit | 285/188 |
| 4,087,577 | A | 5/1978 | Hendrickson | 428/110 |
| 4,139,664 | A | 2/1979 | Wenrick | 428/31 |
| 4,240,604 | A | 12/1980 | Brach | 248/316 |
| 4,263,079 | A | 4/1981 | Sutrina et al. | 156/244.11 |
| 4,268,938 | A | 5/1981 | Walchli | 24/201 |
| 4,279,677 | A | 7/1981 | Takahashi | 156/160 |
| 4,306,924 | A | 12/1981 | Kamp | 156/66 |
| 4,315,963 | A | 2/1982 | Havens | 428/35 |
| 4,354,541 | A | 10/1982 | Tilman | 150/3 |
| 4,363,345 | A | 12/1982 | Scheibner | 150/ 3 |
| 4,372,014 | A | 2/1983 | Simpson | 24/201 |
| 4,419,159 | A | 12/1983 | Herrington | 156/66 |
| 4,428,788 | A | 1/1984 | Kamp | 156/66 |
| 4,484,352 | A | 11/1984 | Katzin | 383/65 |
| 4,515,647 | A | 5/1985 | Behr | 156/91 |
| 4,522,678 | A | 6/1985 | Zieke | 156/501 |
| 4,532,652 | A | 7/1985 | Herrington | 383/103 |
| 4,555,282 | A | 11/1985 | Yano | 156/66 |
| 4,561,108 | A | 12/1985 | Kamp | 383/63 |
| 4,561,109 | A | 12/1985 | Herrington | 383/65 |
| 4,562,027 | A | 12/1985 | Behr et al. | 264/146 |
| 4,578,813 | A | 3/1986 | Ausnit | 383/65 |
| 4,615,045 | A | 9/1986 | Siegel | 383/5 |
| 4,618,383 | A | 10/1986 | Herrington | 156/66 |
| 4,655,862 | A | 4/1987 | Christoff et al. | 156/66 |
| 4,665,557 | A | 5/1987 | Kamp | 383/63 |
| 4,672,723 | A | 6/1987 | Hugues et al. | 24/587 |
| 4,673,383 | A | 6/1987 | Bentsen | 493/381 |
| 4,676,851 | A | 6/1987 | Scheibner et al. | 156/66 |
| 4,683,015 | A | 7/1987 | Wagers | 156/66 |
| 4,684,018 | A | 8/1987 | Jarund | 206/306 |
| 4,698,118 | A | 10/1987 | Takahashi | 156/499 |
| 4,701,358 | A | 10/1987 | Behr et al. | 428/35 |
| 4,709,399 | A | 11/1987 | Sanders | 383/66 |
| 4,710,968 | A | 12/1987 | Borchardt et al. | 383/63 |
| 4,727,709 | A | 3/1988 | Zieke et al. | 53/551 |
| 4,736,451 | A | 4/1988 | Ausnit | 383/65 |
| 4,736,496 | A | 4/1988 | Fisher et al. | 24/587 |
| 4,741,789 | A | 5/1988 | Zieke et al. | 156/66 |
| 4,755,248 | A | 7/1988 | Geiger et al. | 156/244.25 |
| 4,764,977 | A | 8/1988 | Wagers | 383/63 |
| 4,765,036 | A | 8/1988 | Iguchi et al. | 24/289 |
| 4,778,282 | A | 10/1988 | Borchardt et al. | 383/63 |
| 4,787,880 | A | 11/1988 | Ausnit | 493/213 |
| 4,791,710 | A | 12/1988 | Nocek et al. | 24/587 |
| 4,792,240 | A | 12/1988 | Ausnit | 383/63 |
| 4,796,300 | A | 1/1989 | Branson | 383/63 |
| 4,812,056 | A | 3/1989 | Zieke | 383/65 |
| 4,812,192 | A | 3/1989 | Woods et al. | 156/251 |
| 4,822,539 | A | 4/1989 | Tilman et al. | 264/40.4 |
| 4,829,641 | A | 5/1989 | Williams | 24/587 |
| 4,832,768 | A | 5/1989 | Takahashi | 156/66 |
| 4,834,554 | A | 5/1989 | Stetler, Jr. et al. | 383/100 |
| 4,846,586 | A | 7/1989 | Bruno | 383/9 |
| 4,854,917 | A | 8/1989 | Mizukoshi | 464/111 |
| 4,859,259 | A | 8/1989 | Scheibner | 156/66 |
| 4,869,725 | A | 9/1989 | Schneider et al. | 604/408 |
| 4,898,492 | A | 2/1990 | Janowski | 403/340 |
| 4,906,310 | A | 3/1990 | Broderick et al. | 156/66 |
| 4,907,321 | A | 3/1990 | Williams | 24/587 |
| 4,929,487 | A | 5/1990 | Tilman et al. | 428/163 |
| 4,964,739 | A | 10/1990 | Branson et al. | 383/5 |
| 5,009,828 | A | 4/1991 | McCree | 264/177.1 |
| 5,012,561 | A | 5/1991 | Porchia et al. | 24/576 |
| 5,017,021 | A | 5/1991 | Simonsen et al. | 383/63 |
| 5,022,530 | A | 6/1991 | Zieke | 206/618 |
| 5,023,122 | A | 6/1991 | Boeckmann et al. | 428/43 |
| 5,049,223 | A | 9/1991 | Dais et al. | 156/244.11 |
| 5,053,091 | A | 10/1991 | Giljam et al. | 156/66 |
| 5,056,933 | A | 10/1991 | Kamp | 383/63 |
| 5,067,822 | A | 11/1991 | Wirth et al. | 383/61 |
| 5,070,584 | A | 12/1991 | Dais et al. | 24/587 |
| 5,092,684 | A | 3/1992 | Weeks | 383/61 |
| 5,138,750 | A | 8/1992 | Gundlach et al. | 24/587 |
| 5,140,727 | A | 8/1992 | Dais et al. | 24/587 |
| 5,141,577 | A | 8/1992 | Porchia et al. | 156/66 |
| 5,154,086 | A | 10/1992 | Porchia et al. | 73/818 |
| 5,167,454 | A | 12/1992 | Woods et al. | 383/35 |
| 5,192,135 | A | 3/1993 | Woods et al. | 383/63 |
| 5,198,055 | A | 3/1993 | Wirth et al. | 156/66 |
| 5,209,574 | A | 5/1993 | Tilman | 383/63 |
| 5,211,481 | A | 5/1993 | Tilman | 383/63 |
| 5,235,731 | A | 8/1993 | Anzai et al. | 24/576 |
| 5,238,306 | A | 8/1993 | Heintz et al. | 383/61 |
| 5,248,201 | A | 9/1993 | Kettner et al. | 383/63 |
| 5,252,281 | A | 10/1993 | Kettner et al. | 264/171 |
| 5,259,904 | A | 11/1993 | Ausnit | 156/244.15 |
| 5,307,552 | A | 5/1994 | Dais et al. | 29/453 |
| 5,326,176 | A | 7/1994 | Domke | 383/103 |
| 5,356,222 | A | 10/1994 | Kettner et al. | 383/63 |
| 5,358,334 | A | 10/1994 | Simonsen | 383/63 |
| 5,366,294 | A | 11/1994 | Wirth et al. | 383/61 |
| 5,368,394 | A | 11/1994 | Scott et al. | 383/63 |
| 5,369,847 | A | 12/1994 | Naya et al. | 24/30.5 |
| 5,382,094 | A | 1/1995 | Ausnit | 383/65 |
| 5,384,942 | A | 1/1995 | Siegel | 24/587 |
| 5,388,910 | A | 2/1995 | Koyanagi | 383/100 |
| 5,397,182 | A | 3/1995 | Gaible et al. | 383/63 |
| 5,403,094 | A | 4/1995 | Tomic | 383/63 |
| 5,405,561 | A | 4/1995 | Dais et al. | 264/40.1 |
| 5,415,904 | A | 5/1995 | Takubo et al. | 428/35.2 |
| 5,462,360 | A | 10/1995 | Tilman et al. | 383/63 |
| 5,472,082 | A | 12/1995 | Thiele | 206/284 |
| 5,478,228 | A | 12/1995 | Dais et al. | 425/294 |
| 5,492,705 | A | 2/1996 | Porchia et al. | 426/106 |
| 5,509,734 | A | 4/1996 | Ausnit | 383/63 |
| 5,511,884 | A | 4/1996 | Bruno et al. | 383/63 |
| 5,525,363 | A | 6/1996 | Herber et al. | 426/130 |
| 5,527,112 | A | 6/1996 | Dais et al. | 383/211 |
| 5,558,439 | A | 9/1996 | Tilman | 383/63 |
| 5,564,834 | A | 10/1996 | Porchia et al. | 383/211 |
| 5,575,747 | A | 11/1996 | Dais et al. | 493/213 |
| 5,577,305 | A | 11/1996 | Johnson | 24/587 |
| 5,618,111 | A | 4/1997 | Porchia et al. | 383/63 |
| 5,647,100 | A | 7/1997 | Porchia et al. | 24/30.5 |
| 5,660,479 | A | 8/1997 | May et al. | 383/204 |
| 5,664,299 | A | 9/1997 | Porchia et al. | 24/400 |
| 5,669,715 | A | 9/1997 | Dobreski et al. | 383/5 |
| 5,672,009 | A | 9/1997 | Malin | 383/204 |
| 5,686,126 | A | 11/1997 | Noel et al. | 426/127 |
| 5,689,866 | A | 11/1997 | Kasai et al. | 24/587 |
| 5,713,669 | A | 2/1998 | Thomas et al. | 383/204 |
| 5,718,024 | A | 2/1998 | Robbins | 24/30.5 R |
| 5,722,128 | A | 3/1998 | Toney et al. | 24/400 |
| 5,729,876 | A | 3/1998 | Johnson | 24/587 |
| 5,749,658 | A | 5/1998 | Kettner | 383/204 |
| 5,769,772 | A | 6/1998 | Wiley | 493/189 |
| 5,774,954 | A | 7/1998 | Ramsey et al. | 24/587 |
| 5,774,955 | A | 7/1998 | Borchardt et al. | 24/587 |
| 5,775,812 | A | 7/1998 | St. Phillips et al. | 383/5 |
| 5,783,012 | A | 7/1998 | Porchia et al. | 156/66 |
| 5,791,783 | A | 8/1998 | Porchia et al. | 383/211 |

| | | | | |
|---|---|---|---|---|
| 5,794,315 | A | 8/1998 | Crabtree et al. | 24/587 |
| 5,804,265 | A | 9/1998 | Saad et al. | 428/35.2 |
| 5,809,621 | A | 9/1998 | McCree et al. | 24/399 |
| 5,817,380 | A | 10/1998 | Tanaka | 428/35.7 |
| 5,827,163 | A | 10/1998 | Kettner | 493/211 |
| 5,832,145 | A | 11/1998 | Dais et al. | 383/211 |
| 5,832,570 | A | 11/1998 | Thorpe et al. | 24/587 |
| 5,832,699 | A | 11/1998 | Zobel | 53/461 |
| 5,836,056 | A | 11/1998 | Porchia et al. | 24/400 |
| 5,839,831 | A | 11/1998 | Mazzocchi | 383/65 |
| D406,685 | S | 3/1999 | McGinnis | D2/641 |
| 5,878,468 | A | 3/1999 | Tomic et al. | 24/576 |
| 5,894,707 | A | 4/1999 | May | 53/133.7 |
| 5,902,046 | A | 5/1999 | Shibata | 383/107 |
| 5,911,508 | A | 6/1999 | Dobreski et al. | 383/5 |
| 5,927,855 | A | 7/1999 | Tomic et al. | 383/5 |
| 5,930,877 | A | 8/1999 | Thorpe et al. | 24/587 |
| 5,933,927 | A | 8/1999 | Miller et al. | 24/452 |
| 5,950,285 | A | 9/1999 | Porchia et al. | 24/400 |
| 5,953,796 | A | 9/1999 | McMahon et al. | 24/400 |
| 5,955,160 | A | 9/1999 | Tanaka et al. | 428/34.1 |
| 5,962,040 | A | 10/1999 | Dais et al. | 425/290 |
| 5,964,532 | A | 10/1999 | St. Phillips et al. | 383/5 |
| 5,988,880 | A | 11/1999 | Tomic | 383/63 |
| 6,009,603 | A | 1/2000 | Gallagher | 24/587 |
| 6,010,244 | A | 1/2000 | Dobreski et al. | 383/63 |
| 6,014,795 | A | 1/2000 | McMahon et al. | 24/400 |
| 6,021,557 | A | 2/2000 | Dais et al. | 29/453 |
| 6,030,122 | A | 2/2000 | Ramsey et al. | 383/61 |
| 6,032,437 | A | 3/2000 | Bois | 53/412 |
| 6,071,011 | A | 6/2000 | Thomas et al. | 383/64 |
| 6,074,096 | A | 6/2000 | Tilman | 383/63 |
| 6,077,208 | A | 6/2000 | Larkin et al. | 493/223 |
| 6,080,252 | A | 6/2000 | Plourde | 156/66 |
| 6,085,906 | A | 7/2000 | Lambert | 206/524.8 |
| 6,110,586 | A | 8/2000 | Johnson | 428/352 |
| 6,112,374 | A | 9/2000 | Van Erden | 24/400 |
| 6,135,636 | A | 10/2000 | Randall | 383/64 |
| 6,138,329 | A | 10/2000 | Johnson | 24/587 |
| 6,148,588 | A | 11/2000 | Thomas et al. | 53/412 |
| 6,149,302 | A | 11/2000 | Taheri | 383/5 |
| 6,152,600 | A | 11/2000 | Tomic | 383/63 |
| 6,156,363 | A | 12/2000 | Chen et al. | 426/410 |
| 6,164,825 | A | 12/2000 | Larkin et al. | 383/104 |
| 6,167,597 | B1 | 1/2001 | Malin | 24/587 |
| 6,170,985 | B1 | 1/2001 | Shabram, Jr. et al. | 383/100 |
| 6,185,796 | B1 | 2/2001 | Ausnit | 24/587 |
| 6,187,396 | B1 | 2/2001 | Möller | 428/34.3 |
| 6,212,061 | B1 | 4/2001 | Irwin et al. | 361/502 |
| 6,217,215 | B1 | 4/2001 | Tomic | 383/63 |
| 6,217,216 | B1 | 4/2001 | Taheri | 383/207 |
| 6,220,754 | B1 | 4/2001 | Stiglie et al. | |
| 6,221,484 | B1 | 4/2001 | Leiter | 428/343 |
| 6,228,485 | B1 | 5/2001 | Leiter | 428/343 |
| 6,231,236 | B1 | 5/2001 | Tilman | 383/63 |
| 6,244,748 | B1 | 6/2001 | Kasai et al. | |
| 6,257,763 | B1 | 7/2001 | Stolmeier et al. | 383/5 |
| 6,279,298 | B1 | 8/2001 | Thomas et al. | 53/412 |
| 6,286,681 | B1 | 9/2001 | Wilfong, Jr. et al. | 206/554 |
| 6,286,999 | B1 | 9/2001 | Cappel et al. | 383/5 |
| 6,299,720 | B1 | 10/2001 | Van Erden | 156/244.19 |
| 6,318,894 | B1 | 11/2001 | Derenthal | 383/204 |
| 6,321,423 | B1 | 11/2001 | Johnson | 24/585.12 |
| 6,341,688 | B1 * | 1/2002 | Graham | 206/63.5 |
| 6,360,513 | B1 | 3/2002 | Strand et al. | 53/412 |
| 6,364,915 | B1 | 4/2002 | Chapman-Irwin et al. | 29/25.03 |
| 6,398,412 | B2 * | 6/2002 | Wedi et al. | 383/211 |
| 6,461,042 | B1 | 10/2002 | Tomic et al. | 383/64 |
| 6,461,043 | B1 | 10/2002 | Healy et al. | 383/204 |
| 6,481,890 | B1 | 11/2002 | VandenHeuvel | 383/64 |
| 6,487,758 | B2 | 12/2002 | Shaffer et al. | 24/585.12 |
| 6,491,433 | B2 | 12/2002 | Shabram, Jr. et al. | 383/100 |
| 6,539,594 | B1 | 4/2003 | Kasai et al. | 24/585.12 |
| 6,582,122 | B2 | 6/2003 | Shimizu | 383/63 |
| 6,592,260 | B1 | 7/2003 | Randall et al. | 383/64 |
| 6,594,868 | B1 | 7/2003 | Savicki | 24/30.5 |
| 6,594,872 | B2 | 7/2003 | Cizek | 24/401 |
| 6,637,939 | B2 | 10/2003 | Huffer | 383/64 |
| 6,686,005 | B2 | 2/2004 | White et al. | 428/35.2 |
| 6,691,383 | B2 | 2/2004 | Linton | 24/585.12 |
| 6,712,509 | B2 | 3/2004 | Cappel | 383/5 |
| 7,036,988 | B2 * | 5/2006 | Olechowski | 383/210.1 |
| 7,137,736 | B2 | 11/2006 | Pawloski et al. | |
| 7,189,001 | B2 * | 3/2007 | Gerrits | 383/63 |
| 2001/0043763 | A1 | 11/2001 | Saad et al. | 383/63 |
| 2002/0034343 | A1 * | 3/2002 | Bois | 383/59 |
| 2002/0090151 | A1 | 7/2002 | Skeens et al. | 383/100 |
| 2002/0114540 | A1 | 8/2002 | Shimizu | 383/63 |
| 2002/0153273 | A1 | 10/2002 | Mallik et al. | 206/459.1 |
| 2002/0173414 | A1 | 11/2002 | Leighton | 493/213 |
| 2003/0033694 | A1 | 2/2003 | Cisek | 24/401 |
| 2003/0066267 | A1 | 4/2003 | Nelson | 53/412 |
| 2003/0077008 | A1 | 4/2003 | Plourde et al. | 383/63 |
| 2003/0077243 | A1 | 4/2003 | Fitzhugh et al. | 424/78.27 |
| 2003/0167607 | A1 | 9/2003 | Linton | 24/585.12 |
| 2003/0169947 | A1 | 9/2003 | Taheri | 383/5 |
| 2003/0169948 | A1 | 9/2003 | Fenzl et al. | 383/61.2 |
| 2003/0177619 | A1 | 9/2003 | Cisek | 24/585.12 |
| 2003/0210836 | A1 | 11/2003 | Strand | 383/9 |
| 2003/0219174 | A1 | 11/2003 | Piechocki | 383/59 |
| 2003/0223654 | A1 | 12/2003 | Gerrits | 383/63 |
| 2003/0223657 | A1 | 12/2003 | Belias et al. | 383/105 |
| 2004/0001650 | A1 | 1/2004 | Piechocki et al. | 383/59 |
| 2004/0010893 | A1 * | 1/2004 | Kasai | 24/438 |
| 2004/0047521 | A1 | 3/2004 | Berich et al. | 383/63 |
| 2004/0078940 | A1 | 4/2004 | Ishizaki | 24/400 |
| 2004/0091179 | A1 | 5/2004 | Anderson | 383/63 |
| 2004/0234171 | A1 | 11/2004 | Dais et al. | |
| 2004/0234172 | A1 | 11/2004 | Pawloski | |
| 2005/0141786 | A1 | 6/2005 | Piechocki et al. | |
| 2005/0235468 | A1 | 10/2005 | Borchardt et al. | |
| 2005/0271308 | A1 | 12/2005 | Pawloski | |

FOREIGN PATENT DOCUMENTS

| | | | | |
|---|---|---|---|---|
| CH | 540 162 | A | 8/1973 | |
| DE | 831 985 | | 2/1952 | 3/3 |
| DE | 2 036 432 | | 2/1971 | 81/8 |
| DE | 30 32 889 | | 12/1981 | 33/16 |
| EP | 0 025 656 | | 3/1981 | 33/24 |
| EP | 0 089 680 | | 9/1983 | |
| EP | 0 114 373 | | 8/1984 | 33/16 |
| EP | 0 155 612 | | 9/1985 | |
| EP | 0 220 476 | | 5/1987 | 33/25 |
| EP | 0 241 334 | | 10/1987 | 19/16 |
| EP | 0 398 731 | | 11/1990 | 33/25 |
| EP | 0 427 010 | | 5/1991 | 19/16 |
| EP | 0 543 737 | | 5/1993 | 33/25 |
| EP | 0970632 | A1 | 1/2000 | |
| EP | 1 038 774 | | 9/2000 | 9/20 |
| EP | 1 329 387 | | 7/2003 | 61/18 |
| FR | 1493748 | | 7/1967 | 29/44 |
| FR | 1 517 531 | A | 3/1968 | |
| FR | 2 620 377 | | 3/1989 | 5/10 |
| GB | 998967 | | 7/1965 | |
| GB | 1092452 | | 11/1967 | 65/8 |
| GB | 1156170 | | 6/1969 | 27/20 |
| GB | 1326945 | | 8/1973 | 27/20 |
| GB | 2 008 538 | | 6/1979 | 33/14 |
| GB | 2037704 | A | 7/1980 | |
| GB | 2 116 144 | | 9/1983 | 33/1 |
| GB | 2 117 351 | | 10/1983 | 33/24 |
| JP | 2-15437 | | 1/1990 | |
| JP | 3 212355 | | 9/1991 | 33/10 |
| JP | 04057768 | | 2/1992 | 81/34 |
| JP | 6 99991 | | 4/1994 | 30/10 |

| | | | |
|---|---|---|---|
| JP | 6 227551 | 8/1994 | ..... 33/1 |
| JP | 07223657 | 8/1995 | |
| WO | WO 88/04634 | 6/1988 | ..... 33/24 |
| WO | WO 02/34634 | 5/2002 | ..... 33/2 |

OTHER PUBLICATIONS

Web page from www.zippak.com "At-140 Zipper".
Web page from www.ambag.com "Double Track Seal Top Bags".
Web pages from www.ambag.com "Ambag Corporation Custom Plain Bag Guidelines" (7 pages).
Web pages from www.plastic-bags.net "Plastic Bags" (2 pages).
Photo-micrograph of "Fresh Pack Zipper" from Chantler Packaging (see http://www.chantlerpackaging.com).
Web pages of "Ziplock Bag," by Rean Tai Plastic Co., Ltd at http://www.reantai.ttnet.net, (4 pages).
Photographs of "Zipper Bag" from Thai Griptech Co., Ltd, of Thailand (3 pages).
Photo-micrograph of "Zipper Bag" from Thai Griptech Co., Ltd. of Thailand.
Photographs of "Ziploc Heavy Duty Big Bags" from S. C. Johnson & Son, Inc., Large 21/4 Gallon Size (8.52 L), (4 pages).
Photographs of "Vegetables & Fruits Fresh Pack" from Slim Kitchen, 280mmX270mm, (3 pages).
Photographs of "Breast Milk Storage Bags" from Lansinoh, (4 pages).
Web pages of "Breast Milk Storage Bags" by Lansinoh at http://store.babycenter.com/product/feeding/breastfeeding/pump accessories/3961, (2 pages).
Photographs of box for "Breast Milk Storage Bags" by Lansinoh, (2 pages).
Photographs of double zipper bag, name and origin unknown, (4 pages).
Web pages of "4-Mil Double-Track Zip Poly Bags" advertised by Realemall.com at http://office-supply.realemall.com/B-O-X-Packaging/4Mil-DoubleTrack-Zip-Poly-Bags.asp, 5 pages.
Web pages of "4-Mil Double-Track Zip Poly Bags" sold by Office Depot, 12"×15", Box Of 500, at http://www.officedepot.com/ddSKU.do?level=SK&id=499978, 2 pages.
Web article "MS-1000 Offers Maximum Versatility" May 20, 2002 at http://www.packexpo.com/ve/34472/news/3070.html, 2 pages.
Web pages of "Drawstring Bags" advertised manufactured by Co-Ordinated Packaging, Inc. at http://www.co-ordinatedpackaging.com/specimen_bags.htm, 2 pages.
Office Action in U.S. Appl. No. 10/875,391 dated Feb. 7, 2007.
Office Action in U.S. Appl. No. 10/875,391 dated Jun. 19, 2007.
Office Action in U.S. Appl. No. 10/440,822 dated Mar. 1, 2005.
Office Action in U.S. Appl. No. 10/440,822 dated May 23, 2005.
Office Action in U.S. Appl. No. 10/440,822 dated Nov. 4, 2005.
Office Action in U.S. Appl. No. 10/440,639 dated Feb. 11, 2005.
Office Action in U.S. Appl. No. 10/440,639 dated Jul. 26, 2005.
Office Action in U.S. Appl. No. 10/440,639 dated Nov. 18, 2005.
Office Action in U.S. Appl. No. 10/440,639 dated May 17, 2006.
Office Action in U.S. Appl. No. 10/821,341 dated Jun. 18, 2007.
U.S. Appl. No. 10/821,341, Office Action dated Jun. 18, 2007.
U.S. Appl. No. 10/875,391, Office Action dated Jun. 19, 2007.
Office Action in U.S. Appl. No. 10/836,302 dated Oct. 17, 2007.
Office Action in U.S. Appl. No. 10/821,341 dated Dec. 10, 2007.
Office Action in U.S. Appl. No. 10/836,302 dated May 23, 2008.

* cited by examiner

CLOSURE DEVICE FOR A RECLOSABLE POUCH

CROSS REFERENCE TO RELATED APPLICATIONS

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to closures for reclosable pouches, and more particularly, to such closures that include two closure mechanisms comprised of male and female closure elements.

2. Description of the Background of the Invention

A thermoplastic pouch for the storage of items typically includes a closure mechanism comprising multiple profiles disposed on opposed inner surfaces of pouch walls. In a specific example, two sets of profiles are disposed on pouch walls wherein each set includes a male and a female closure element.

Ausnit U.S. Pat. No. 3,656,147 discloses a plastic bag having male and female resealable interlocking elements integrally attached thereto for selectively opening and closing an end of the bag. The bag further includes a pair of stiffener ribs formed integrally with the bag and disposed below the resealable elements to provide increased rigidity along an open end of the bag to prevent inadvertent separation of the elements.

Ausnit U.S. Pat. No. 4,787,880 discloses a bag having first and second zipper strip bases secured to opposing wall panels of the bag. The bases each include at least two arrow-shaped profiles extending therefrom to engage with the profiles of the opposing base, wherein the profiles of the same base are adjacent one another.

Ausnit U.S. Pat. No. 4,792,240 discloses a bag having a reclosable zipper including first and second base members each having a plurality of interlocking zipper profile parts extending therefrom. The bottom-most profile part has a head having a greater mass than the head of the other profile parts to resist opening of the zipper due to internal pressures.

Johnson U.S. Pat. No. 6,138,329 discloses a reclosable bag having an assembly that includes first and second male arrow-shaped profiles extending perpendicularly from a first base. The assembly further includes first and second female U-shaped members extending perpendicularly from a second base to engage the first and second male profiles, respectively. Each of the male arrow-shaped profiles includes two prongs extending therefrom that engage with a female profile. The prongs of the second male profile are longer than the prongs of the first male profile to increase the opening force of the second male profile when interlocked with a respective female profile.

Malin U.S. Pat. No. 6,167,597 discloses a zipper strip for a reclosable package, wherein the zipper strip includes a male and a female profile. There are at least two male interlocking members that extend from a base toward the opposite female interlocking members, wherein each male member has an asymmetrical arrow shape so that the zipper is easier to open from one side than the other. One or both of the profiles includes at least one high compression member that extends from a base thereof to touch a base of the opposite profile to allow the profiles to be sealed without crushing or distorting the interlocking members.

Linton U.S. Pat. No. 6,691,383 discloses a webless zipper for a reclosable bag including interlocking male and female profiles. The male profile includes three ribs, wherein each of two of the ribs includes double-barbed end sections at the end of a shaft. The barbs of each end section are asymmetrical with a longer barb facing a product side of the bag to increase the opening force for the product side of the bag. The female profile includes two grooves, defined by legs that interlock with the double-barbed end sections.

SUMMARY OF THE INVENTION

According to one embodiment of the present invention, a reclosable pouch comprises first, second, and third closure mechanisms. When the pouch is closed, the closure mechanisms do not contact one another. The first closure mechanism is adjacent the second closure mechanism but is spaced a first distance therefrom. The second closure mechanism is adjacent the third closure mechanism but is spaced therefrom a second distance. No closure element is disposed between the first and second closure mechanisms and no closure element is disposed between the second and third closure mechanisms. The first and second distances are sufficiently small to permit a user to concurrently close the first, second, and third closure mechanisms. The first and second distances are also sufficiently large to assist in guiding a user during closure of the pouch.

According to another embodiment of the present invention, a reclosable pouch comprises a body portion having first and second pouch walls. A first closure mechanism is disposed on internal sides of the first and second walls. The first closure mechanism includes a first female profile having first and second spaced legs and a first male profile. A second closure mechanism is disposed on the internal sides of the first and second pouch walls. The second closure mechanism includes a second female profile having third and fourth spaced legs and a second male profile. Further, one of the first, second, third, or fourth spaced legs is longer than the other leg of the same female profile.

According to yet another embodiment of the present invention, a reclosable pouch comprises a body portion having first and second pouch walls. A first closure mechanism is disposed on internal sides of the first and second walls. The first closure mechanism includes a first female profile having first and second spaced legs and a first male profile, wherein the first male profile includes only one hook portion extending from an end thereof to engage one of the first or second spaced legs. A second closure mechanism is disposed on internal sides of the first and second walls. The second closure mechanism includes a second female profile having third and fourth spaced legs and a second male profile, wherein the second male profile includes only one hook portion extending from an end thereof to engage one of the third or fourth spaced legs.

In a further embodiment of the present invention, a reclosable pouch comprises a body portion having first and second pouch walls. A first closure mechanism is disposed on internal sides of the first and second walls. The first closure mechanism includes a first female profile having first and second spaced legs and a first male profile, wherein the first male profile includes only one hook portion extending from an end thereof to engage one of the first or second spaced legs. A second closure mechanism is disposed on internal sides of the first and second walls. The second closure mechanism includes a second female profile having third and fourth spaced legs and a second male profile, wherein the second male profile includes only one hook portion extending from an end thereof to engage one of the third or fourth spaced legs. A third closure mechanism is disposed on internal sides of the first and second walls. The third closure mechanism includes a third female profile having fifth and sixth spaced legs and a third male profile.

Other aspects and advantages of the present invention will become apparent upon consideration of the following detailed description and the attached drawings, in which like elements are assigned like reference numerals.

DETAILED DESCRIPTION OF THE PREFERRED EMBODIMENTS

Figure 1:
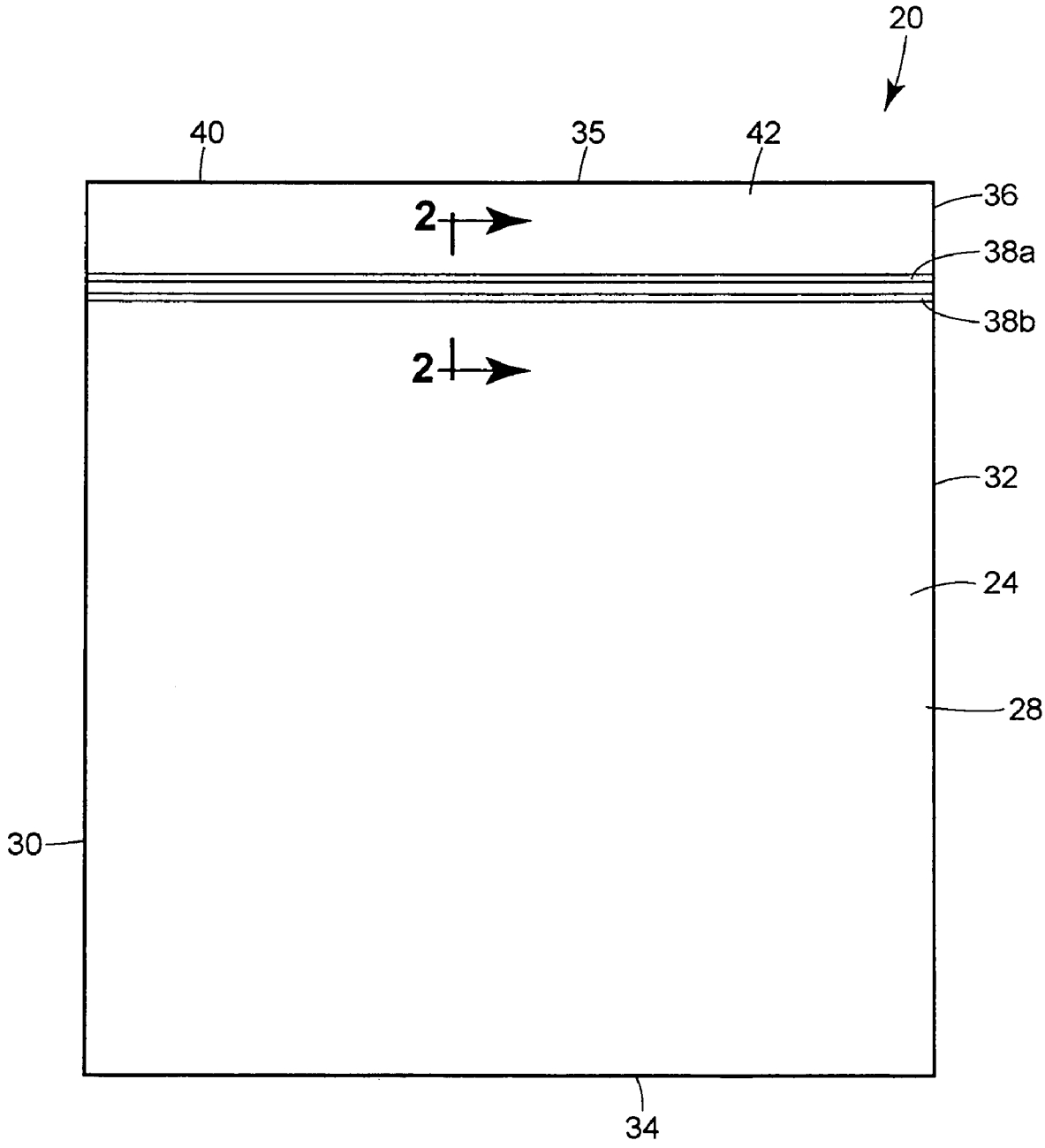
FIG. 1 is an elevational view of a first embodiment of a reclosable thermoplastic storage bag according to the present invention.
Figure 2:
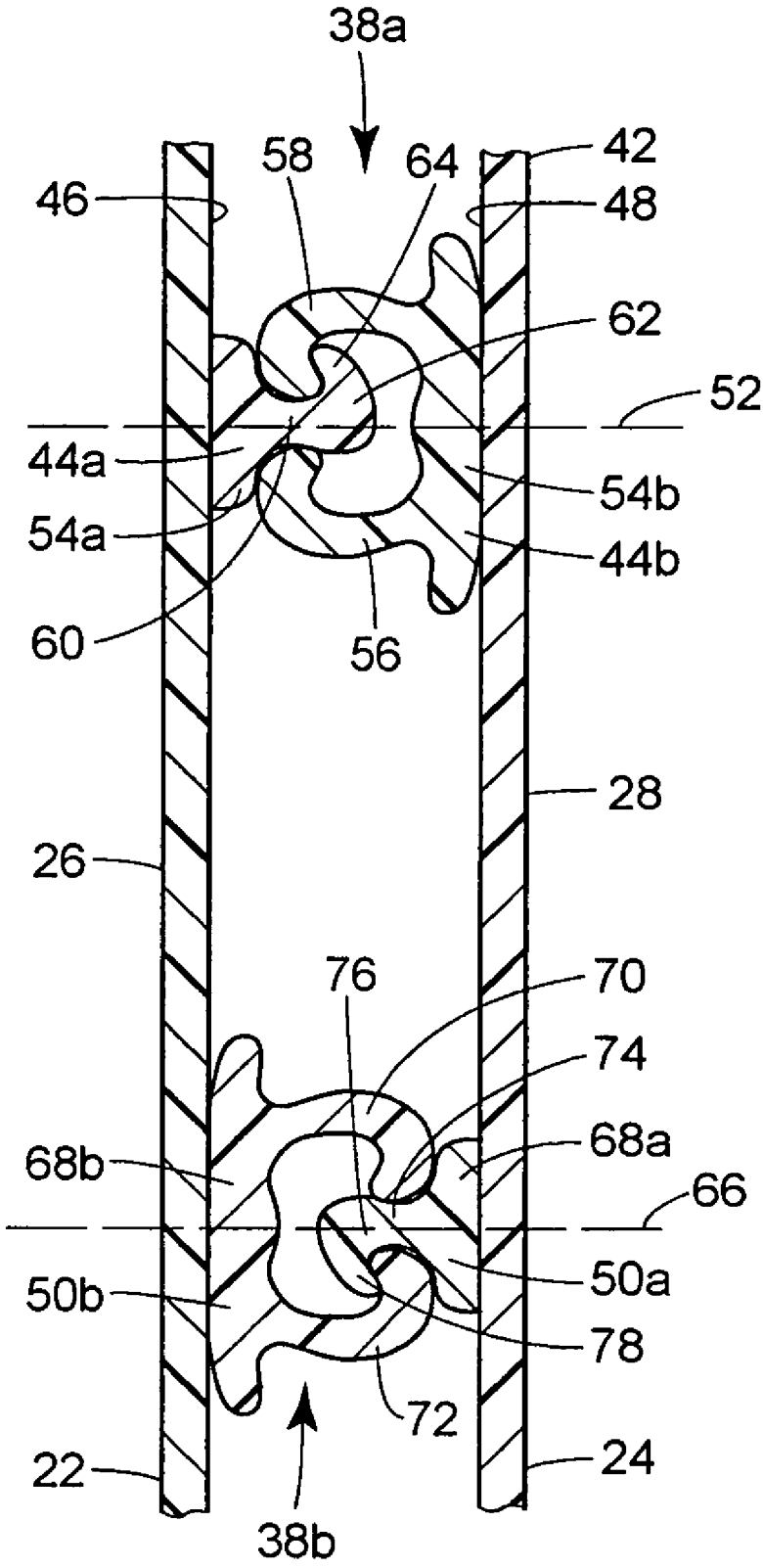
FIG. 2 is an enlarged, fragmentary, sectional view taken generally along the lines 2-2 of FIG. 1 depicting a first embodiment of a closure mechanism of the present invention.

Referring to FIGS. 1 and 2, a reclosable bag in the form of a thermoplastic storage pouch 20 comprises first and second body portions 22, 24 joined to one another to form first and second pouch walls 26, 28. The first and second pouch walls 26, 28 are joined at first and second side portions 30, 32, respectively, and further are either integral with one another are joined together at a bottom portion 34. An opening 35 is disposed at a top portion 36 of the pouch 20. First and second closure mechanisms 38*a*, 38*b* and two lips 40 are also disposed at the top portion 36 of the pouch 20. The first closure mechanism 38*a* is disposed between the second closure mechanism 38*b* and an upper edge 42 of the top portion 36.

Referring to FIG. 2, male and female closure elements or portions 44*a*, 44*b*, respectively, of the first closure mechanism 38*a* are disposed on opposing internal sides or surfaces 46, 48, respectively, of the first and second pouch walls 22, 24, respectively. In addition, male and female closure elements or portions 50*a*, 50*b* of the second closure mechanism 38*b* are disposed on the internal sides or surfaces 48, 46, respectively. Preferably, although not necessarily, the first closure mechanism 38*a* is parallel to the second closure mechanism 38*b* and the two are spaced from one another by a distance that is sufficiently small to create the perception that mechanisms act as a single closure. In addition, the mechanisms 38*a*, 38*b* are preferably disposed sufficiently far apart such that a user's fingers and/or thumb are guided during the closing operation. Typically, these results are accomplished by spacing the mechanisms 38*a*, 38*b* between about 0.1 inch (2.54 mm) and 0.3 inch (7.62 mm) apart, and, more preferably, between about 0.15 inch (3.81 mm) and about 0.25 inch (6.35 mm) apart and most preferably about 0.20 inch (5.08 mm) apart, although a different spacing may instead be used.

Preferably, the closure elements or portions 44, 50 have a cross sectional shape and/or may be formed in accordance with the teachings of U.S. patent application Ser. No. 10/821,341, filed Apr. 9, 2004 (the application is entitled "Closure Device for a Reclosable Pouch," and was filed with an attorney docket No. 29252/3676A), owned by the assignee of the present application and the disclosure of which is hereby incorporated by reference herein. Also preferably, the first closure mechanism 38*a* exhibits a first closure characteristic and the second closure mechanism 38*b* exhibits a second closure characteristic different than the first closure characteristic. For example, either or both of the first and second closure mechanisms 38 may exhibit a relatively low level of resistance to pouch opening forces but provide a high level of deformation so as to exhibit a clicking feel and/or sound when the pouch is opened or closed. In addition, either or both of the first and second closure mechanisms 38 may exhibit a low level of deformation but provide a relatively high overall resistance to pouch opening forces. Further, either or both of the male closure elements 44*a*, 50*a* may be symmetric or asymmetric about a longitudinal centerline thereof and either or both of the female closure elements 44*b*, 50*b* may be symmetric or asymmetric about a longitudinal centerline thereof. Thus, for example, either or both of the first and second closure mechanisms 38 may have an asymmetric configuration so that the closure mechanism 38 exhibits a first resistance to opening forces exerted on one side of the mechanism 38 and further exhibits a second, different resistance to opening forces exerted on another side of the mechanism 38.

The first female closure element 44*b* of FIG. 2 is substantially symmetric about a centerline 52. The first female closure element 44*b* comprises a C-shaped profile and includes a base 54*b* with a first spaced leg 56 and a second spaced leg 58 extending therefrom. The first male closure element 44*a* is substantially asymmetric about the centerline 52. The first male closure element 44*a* includes a base 54*a* with a body 60 extending therefrom. An engagement member 62 is disposed on an end of the body 60, wherein the engagement member 62 has a first hook portion 64 extending therefrom. The first female closure element 44*b* is adapted to receive the first male closure element 44*a* when pressure is exerted on the closure elements by a user's finger(s) during closing of the pouch. In one embodiment, the second female closure element 50*b* is substantially symmetric about a centerline 66. The second female closure element 50*b* also has a C-shaped profile and includes a base 68*b* with third and fourth spaced legs 70, 72, respectively, extending therefrom. The second female closure element 50*b* is also adapted to receive the second male closure element 50*a* when pressure is exerted on the closure elements by a user's finger(s) during closing of the pouch. The second male closure element 50*a* includes a base 68*a* with a body 74 extending therefrom. An engagement member 76 is disposed on an end of the body 74, wherein the engagement member 76 has a second hook portion 78 extending therefrom.

As may be seen in FIG. 2, the first male closure element 44*a* of the first closure mechanism 38*a* is adjacent the second female closure element 50*b* of the second closure mechanism 38*b* on the first pouch wall 26. The first male closure element 44*a* is disposed closer to an upper edge 42 of the pouch on the first pouch wall 26 than the second female closure element 50*b*. Additionally, the first female closure element 44*b* of the first closure mechanism 38*a* is adjacent the second male closure element 50*a* of the second closure mechanism 38*b* on the second pouch wall 28. The first female closure element 44*b* is also disposed closer to an upper edge 42 of the pouch on the second pouch wall 28 than the second male closure element 50*a*. In other embodiments, the first female closure element 44*b* and the second male closure element 50*a* are disposed on the pouch wall 26 and the first male closure element 44*a* and the second female closure element 50*b* are disposed on the pouch wall 28. In still another embodiment, the first and second male closure elements 44*a*, 50*a* are disposed on either of the first or second pouch walls 26, 28 and the first and second female closure elements 44*b*, 50*b* are disposed on the opposing first or second pouch walls 26, 28.

The first closure mechanism 38*a* is opened by disengaging the closure elements 44*a*, 44*b* with a first opening force and the second closure mechanism 38*b* is opened by disengaging the closure elements 50*a*, 50*b* with a second opening force. In one embodiment, the first male closure element 44*a* disengages from the first female closure element 44*b* with a first external opening force and the second male closure element 50*a* disengages from the second female closure element 50*b* with a second external opening force. The first and second external forces are exerted from a side of the pouch nearer the upper edge 42, as opposed to internal bursting forces that act on the closure mechanisms 38*a*, 38*b* from within the pouch. In another embodiment, the first male closure element 44*a* disengages from the first female closure element 44*b* with a first internal opening force and the second male closure element 50*a* disengages from the second female closure element 50*b* with a second internal opening force. The first and second internal opening forces are exerted from a side of the pouch nearer the content side of the pouch 20 and typically comprise bursting forces. Preferably, the first external and internal opening forces of the first closure mechanism 38*a* are different from each other and the second external and internal opening forces of the second closure mechanism 38*b* are different from each other.

The embodiment depicted in FIG. 2 includes the second hook portion 78 extending from the engagement member 76 toward the bottom portion 34 of the pouch 20. By not providing a similar hook portion on the opposite side of the engagement member 76 that is directed toward the opposing upper edge 42 of the pouch 20, differing internal and external opening forces can be established. The elimination of an extra hook portion on the opposing side (toward the upper edge 42) of the engagement member 76 allows for the second female closure element 50*b* to flex less around the second male closure element 50*a* during opening of the pouch 20. The result of the reduced flexing in the second closure mechanism 38*b* is a lower external opening force than exhibited by the first closure mechanism 38*a*. Conversely, the first male closure element 44*a* includes a first hook portion 64 extending from the engagement member 62 toward the upper edge 42 of the pouch 20. The elimination of an extra hook portion on the opposing side (toward the bottom portion 34) of the engagement member 62 allows for the first female closure element 44*b* to flex less around the first male closure element 44*a* when the pouch 20 is opened from an internal side of the pouch 20. The result of the reduced flexing in the first closure mechanism 38*a* is a lower internal opening force than exhibited by the second closure mechanism 38*b*.

The provision of a single hook portion on either of the first or second male closure elements 44*a*, 50*a* also reduces the closing force necessary to engage the first and second closure mechanisms 38*a*, 38*b*. Similar to the opening of the closure mechanisms 38*a*, 38*b* above, the first and second female closure elements 44*b*, 50*b* do not have to stretch as far around the first and second male closure elements 44*a*, 50*a* during closure, because the male closure elements 44*a*, 50*a* only include the first and second hook portions 64, 78, respectively. This reduced stretching allows the first and second closure mechanisms 38*a*, 38*b* to be closed with less force than would be required if the respective male closure elements 44*a*, 50*a* had extra hook portions.

Figure 2A:
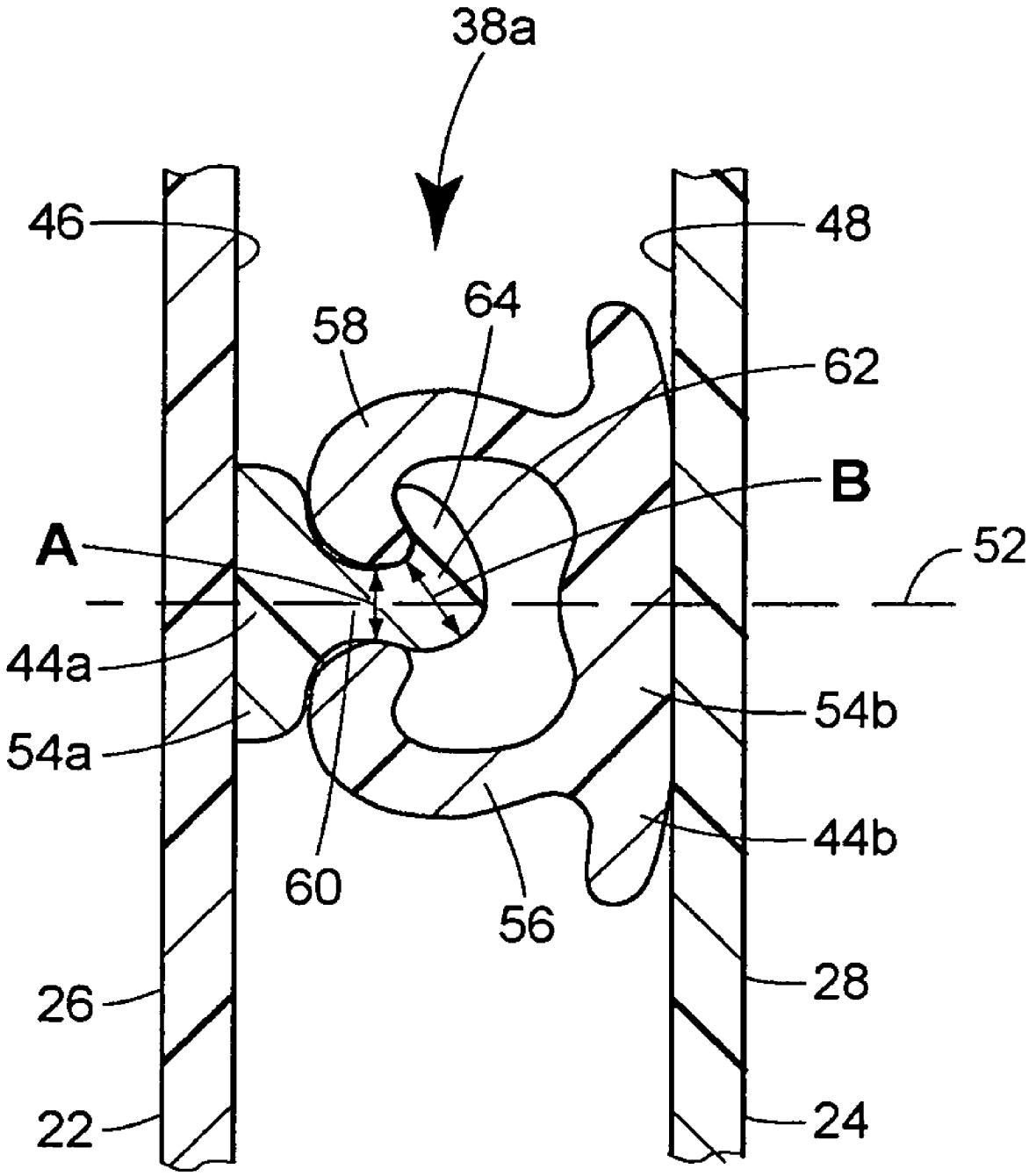
FIG. 2A is an enlarged fragmentary view of FIG. 2.

The force required to open a closure mechanism utilizing an asymmetric male closure element may be adjusted by varying the thickness of the male closure element. As may be seen in FIG. 2A, the first male closure element 44*a* has a thickness A at a portion of the body 60 and a thickness B at the widest part of the hook portion 64. In one embodiment, the thicknesses A and B are substantially equal. Alternatively, the thickness B can be increased, thereby increasing the external opening force developed by the closure mechanism 38*a*. In some embodiments that utilize multiple asymmetric male closure elements, all of the male closure elements have similar thicknesses and opening forces. In other embodiments, each respective male closure element may have its own unique thickness and opening force requirements.

Figure 3:
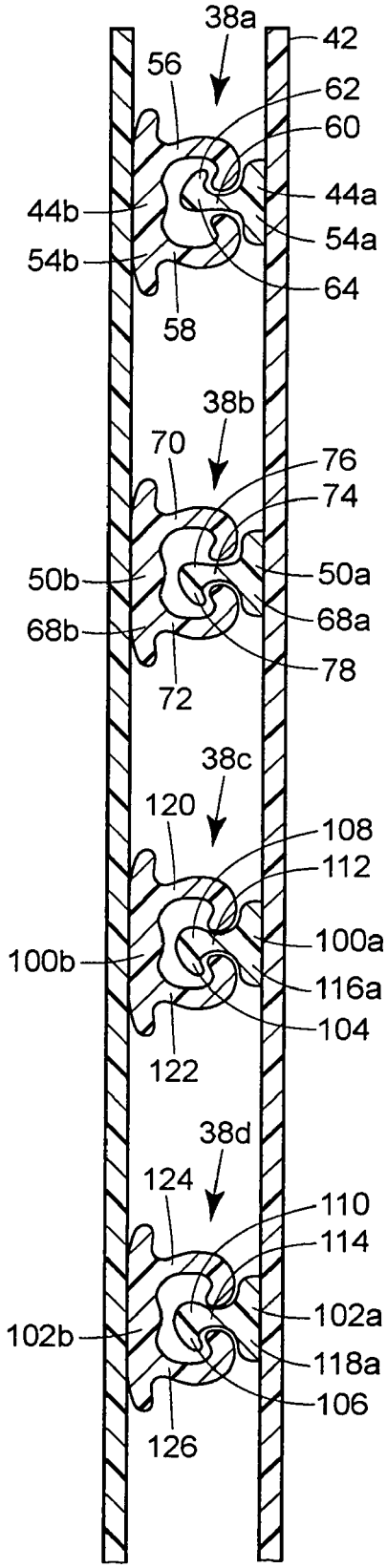
FIGS. 3-11 are views similar to FIG. 2 illustrating alternative closure mechanisms of the present invention.

In other embodiments of the present invention, additional symmetric or asymmetric closure mechanisms may be provided. While it is possible to combine any number of symmetric or asymmetric closure mechanisms within the pouch 20, it is preferred that only a third and a fourth additional closure mechanism 38*c*, 38*d*, respectively, be provided. In one embodiment depicted in FIG. 3, the first male closure element 44*a* is asymmetric. The first hook portion 64 extends from the engagement member 62 toward the upper edge 42 of the pouch 20. Disposed beneath the first closure mechanism 38*a* are second, third, and fourth closure mechanisms 38*b*, 38*c*, 38*d*, respectively. The second, third, and fourth closure mechanisms 38*b*, 38*c*, 38*d*, include second, third, and fourth male closure elements 50*a*, 100*a*, 102*a*, respectively, that are also asymmetric. Second, third and fourth hook portions 78, 104, 106, respectively, extend from engagement members 76, 108, 110, respectively, of the second, third, and fourth male closure elements 50*a*, 100*a*, 102*a*, respectively. The engagement members 62, 76, 108, 110 are disposed on bodies 60, 74, 112, 114, respectively, that extend from bases 54*a*, 68*a*, 116*a*, 118*a*, respectively. The second, third, and fourth hook portions 78, 104, 106 extend toward the bottom portion 34 of the pouch 20 in a direction opposite that of the first male closure element 44*a*. Additionally, the first, second, third, and fourth male closure elements 44*a*, 50*a*, 100*a*, 102*a*, are in opposing and mating relationships with first, second, third, and fourth female closure elements 44*b*, 50*b*, 100*b*, 102*b*, respectively. The first female closure element 44*b* includes first and second spaced legs 56, 58 extending from the base 54*b*, the second female closure element includes third and fourth spaced legs 70, 72 extending from the base 68*b*, the third female closure element includes fifth and sixth spaced legs 120, 122 extending from a base 116*b*, and the fourth female closure element includes seventh and eight spaced legs 124, 126 extending from a base 118*b*.

Figure 4:
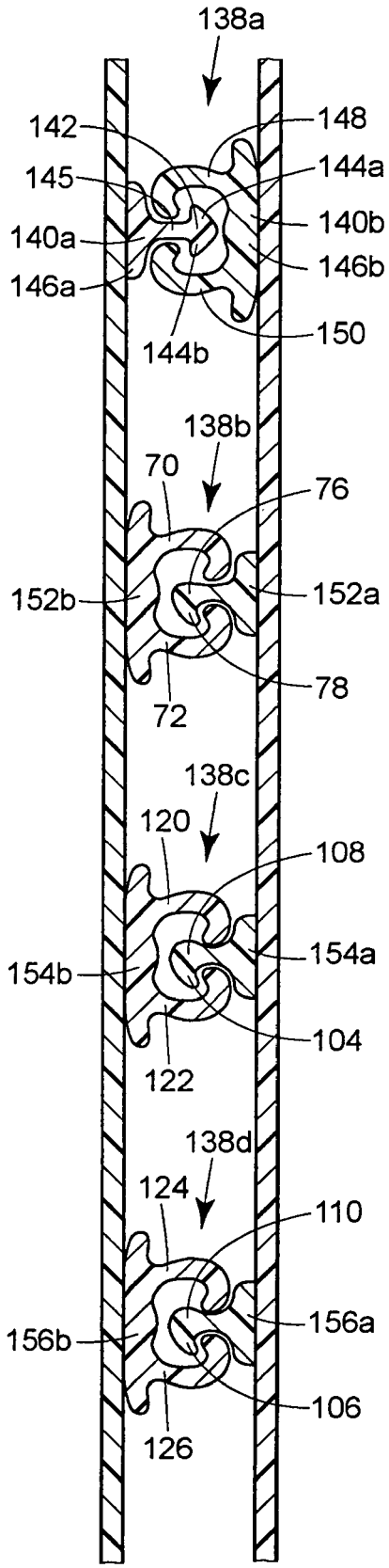

In another embodiment depicted in FIG. 4, a first closure mechanism 138*a* includes a symmetric first male closure element 140*a*. The first male closure element 140*a* includes an engagement member 142 having two hook portions 144*a*, 144*b*. The engagement member 142 is disposed on an end of a body 145, wherein the body is further connected to a base 146*a*. A first female closure element 140*b* is also provided and includes a base 146*b* with a first spaced leg 148 and a second spaced leg 150 extending therefrom. The first female closure element 140*b* is adapted to receive the first male closure element 140*a* when pressure is exerted on the closure elements by a user's finger(s) during closing of the pouch 20. Similar to the prior embodiment, second, third, and fourth closure mechanisms 138*b*, 138*c*, 138*d* are provided with asymmetric second, third, and fourth male closure elements 152*a*, 154*a*, 156*a*, respectively. The second, third, and fourth male closure elements 152*a*, 154*a*, 156*a* are disposed beneath the first male closure element 140*a* and comprise single hook portions 78, 104, 106, respectively, that extend from engagement members 76, 108, 110, respectively. The second, third, and fourth male closure elements 152*a*, 154*a*, 156*a* also include respective second, third, and fourth female closure elements 152*b*, 154*b*, 156*b*. The second, third, and fourth female closure elements 152*b*, 154*b*, 156*b* include pairs of spaced legs similar to prior embodiments.

Figure 5:
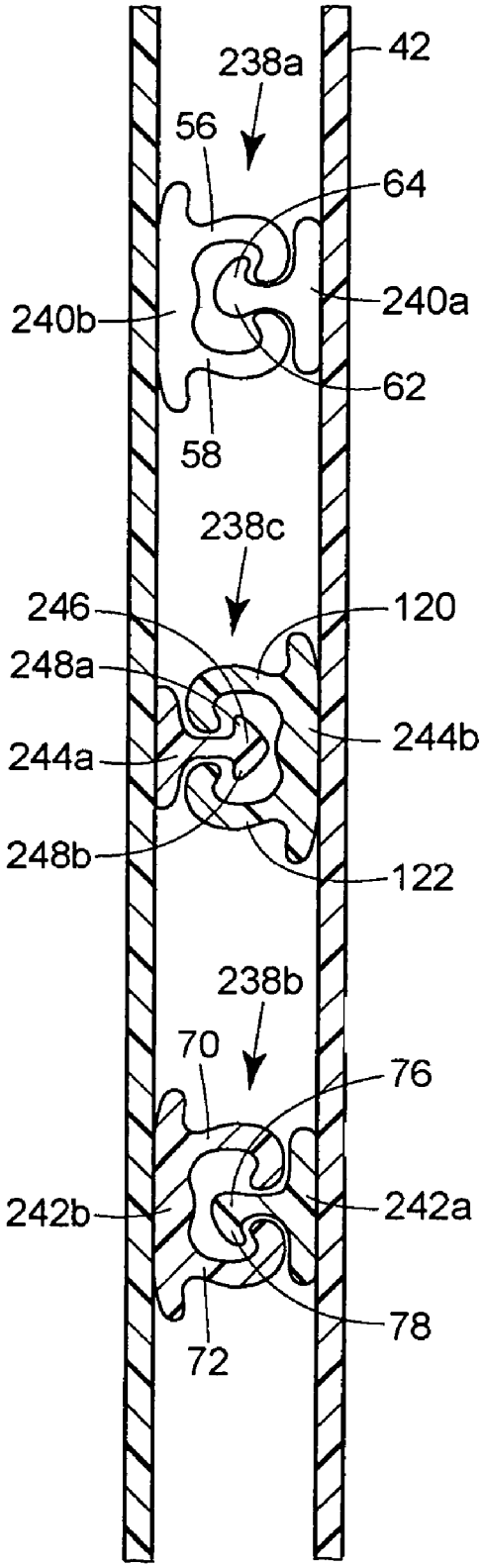

In yet another embodiment depicted in FIG. 5, a first closure mechanism 238*a* is located adjacent the upper edge 42 of the pouch 20 and includes an asymmetric first male closure element 240*a*. The first male closure element 240*a* includes the engagement member 62, wherein the first hook portion 64 extends from the engagement member 64 toward the upper edge 42 of the pouch 20. A second closure mechanism 238*b* is disposed below the first closure mechanism 238*a* and closer to a bottom portion 34 of the pouch 20. The second closure mechanism 238*b* includes an asymmetric second male closure element 242*a*, wherein the second hook portion 78 extends from the engagement member 76 toward the bottom portion 34 of the pouch 20. A third closure mechanism 238*c* is disposed between the first closure mechanism 238*a* and the second closure mechanism 238*b*. The third closure mechanism 238*c* includes a second male closure element 244*a*, wherein the second male closure element 244*a* comprises an engagement member 246 having two hook portions 248*a*, 248*b*. The first, second, and third male closure elements 240*a*, 242*a*, 244*a* include opposing first, second and third female closure elements 240*b*, 242*b*, 244*b* that are similar to the previous embodiments.

The provision of symmetric male closure elements provides for different closure characteristics than the asymmetric male closure elements. Specifically, closure mechanisms utilizing symmetric male closure elements can be formed to exhibit a high degree of deformation so as to develop a clicking feel when the pouch is opened or closed. Preferably, the closure mechanisms are produced in accordance with the teachings of Dais et al., U. S. Pat. Ser. No. 5,140,727, owned by the assignee of the present application and the disclosure of which is hereby incorporated herein.

Figure 6:
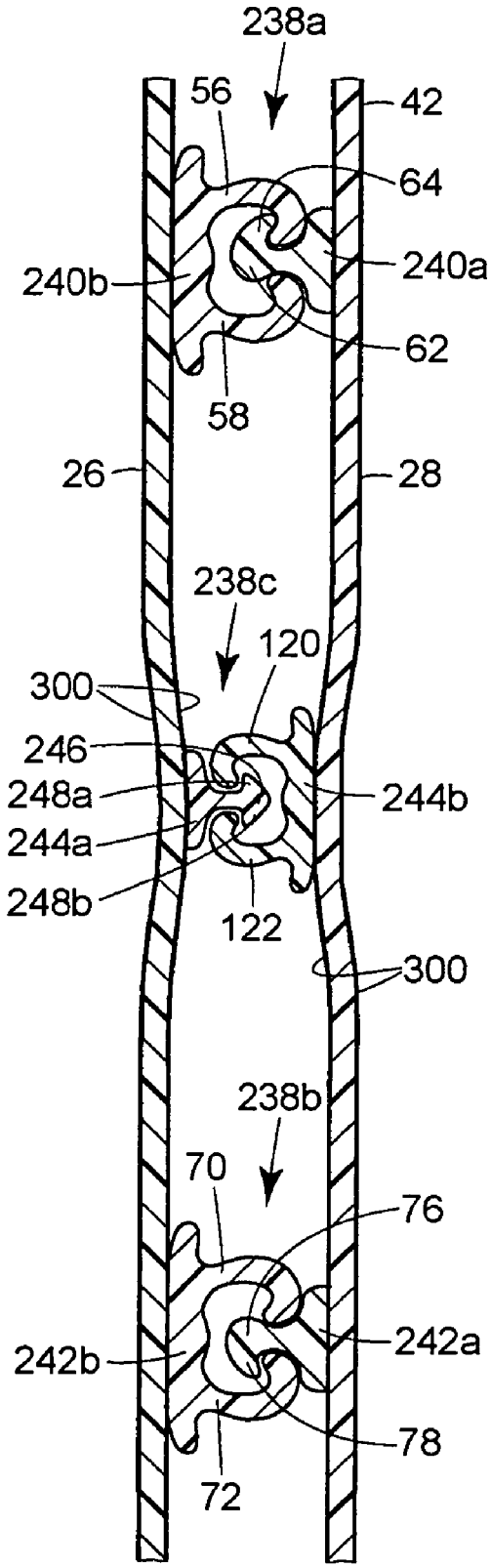

In some embodiments, a channel 300 may be provided for guiding the user's fingers during closure of the pouch 20. The channel 300 may be formed by bending or curving the pouch walls 26, 28 adjacent the closure mechanism near the top portion of the pouch 20. In a different embodiment, the size of at least one of the closure mechanisms of any of the embodiments described herein may be selected to be smaller than adjacent closure mechanisms. For example, FIG. 6, which is similar to the embodiment depicted in FIG. 5, shows the third closure mechanism 238*c* being smaller than the first and second closure mechanisms 238*a*, 238*b*. In so doing, the third closure mechanism 238*c*, which is disposed between the first and second closure mechanisms 238*a*, 238*b*, creates the channel 300 for guiding the user's fingers. It is also envisioned that the first and second closure mechanisms 238*a*, 238*b* of the present embodiment could instead or in addition be made larger. Further, multiple closure mechanisms of any of the embodiments of the present invention could be made smaller or larger depending on the user's requirements.

As should be evident, differing closure mechanisms may be constructed to close with differing closing forces. For example, the first male closure element 140*a* of FIG. 4 engages with the first female closure element 140*b* with a first closing force, the second male closure element 152*a* engages with the second female closure element 152*b* with a second closing force, the third male closure element 154*a* engages with the third female closure element 154*b* with a third closing force, and the fourth male closure element 156*a* engages with the fourth female closure element 156*b* with a fourth closing force. In one embodiment, the first closing force is greater than the second, third, or fourth closing forces. In another embodiment, the second, third, and fourth closing forces are greater than the first closing force. Still further, other embodiments have first, second, third, and fourth closing forces that are approximately equal. Additionally, the second, third, and fourth closing forces may also be different from each other. The spacing, thickness, and type of material used for the male and female closure elements are a few of the characteristics that that can be adjusted to provide for differing closing force requirements. For example, a zipper at a 64 mil thickness (1.6 mm) was found to have an average closing force of 0.15 lb. (0.07 kg.) for the first closure mechanism 138*a* and an average closing force of 0.05 lb. (0.02 kg.) for the second closure mechanism 138*b*. When the zipper thickness was increased to 75 mils (1.9 mm) an average closing force for the first closure mechanism 138*a* was found to be 0.18 lb. (0.08 kg.), an average closing force for the second closure mechanism 138*b* was found to be 0.09 lb. (0.04 kg.).

Figure 7:
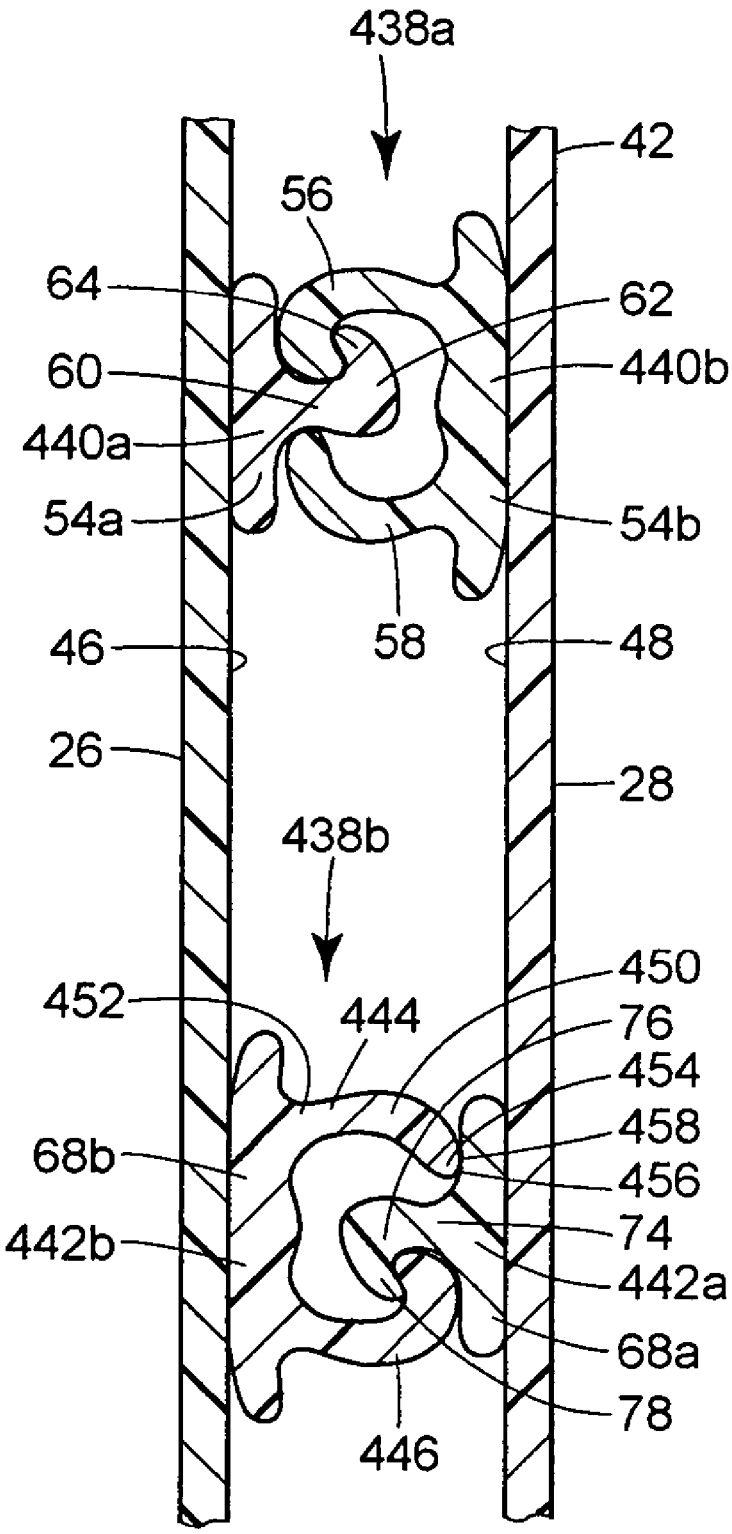

In a further embodiment, a closure mechanism may comprise male and female closure elements that are both asymmetrical. FIG. 7 shows a zipper profile that is similar to FIG. 2, wherein first and second closure mechanisms 438*a*, 438*b* are provided between first and second pouch walls 26, 28. The first closure mechanism includes a first male closure element 440*a* and a first female closure element 440*b*. The first male closure element 440*a* comprises an asymmetrical male profile similar to those described above. The first male closure element 440*a* includes the body 60 extending from the base 54*a*, wherein the engagement member 62 is disposed on the end of the body 60. The first hook portion 64 extends from the engagement member 62 toward the upper edge 42 of the pouch 20. The first female closure element 440*b* comprises a symmetrical C-shaped profile with first and second spaced legs 56, 58. The first and second legs 56, 58 extend from the base 54*b*. The second closure mechanism 438*b* includes a second male closure element 442*a* that is similar to the first male closure element 440*a*. The second male closure element 442*a* includes the body 74 extending from the base 68*a*, wherein the engagement member 76 is disposed on the end of the body 74. The second hook portion 78 extends from the engagement member 76 toward the bottom portion 34 of the pouch 20 in the opposite direction of the first hook portion 64. The second female closure element 442*b* comprises an asymmetrical C-shaped profile that includes third and fourth spaced legs 444, 446, respectively, wherein the third leg 444 is disposed closer to the upper edge 42 than the fourth leg 446. In a one embodiment, the third leg 444 is longer than the first, second, and fourth legs 56, 58, 446. The longer third leg 444 increases the resistance of the second closure mechanism 438*b* to internal opening forces.

The first and second male closure elements 440*a*, 442*a* have similar opening characteristics as discussed in the embodiments above. However, by providing for longer legs, such as the third leg 444 of FIG. 7, the opening forces of the closure mechanisms may be increased. For example, the longer third leg 444 of the second closure mechanism 438*b* forces the second female closure element 442*b* to flex more during internal opening of the pouch 20 than does the first female closure element 440*b*. Similar to the other embodiments discussed above, the first and second male closure elements 440*a*, 442*a* and the respective first and second female closure elements 440*b*, 442*b*, may be disposed on either of the first and second pouch walls 26, 28 and in any order with respect to the upper edge 42 of the pouch as desired. It is also envisioned that additional closure mechanisms may be provided with at least one of the closure mechanisms utilizing a longer spaced leg.

Figure 8:
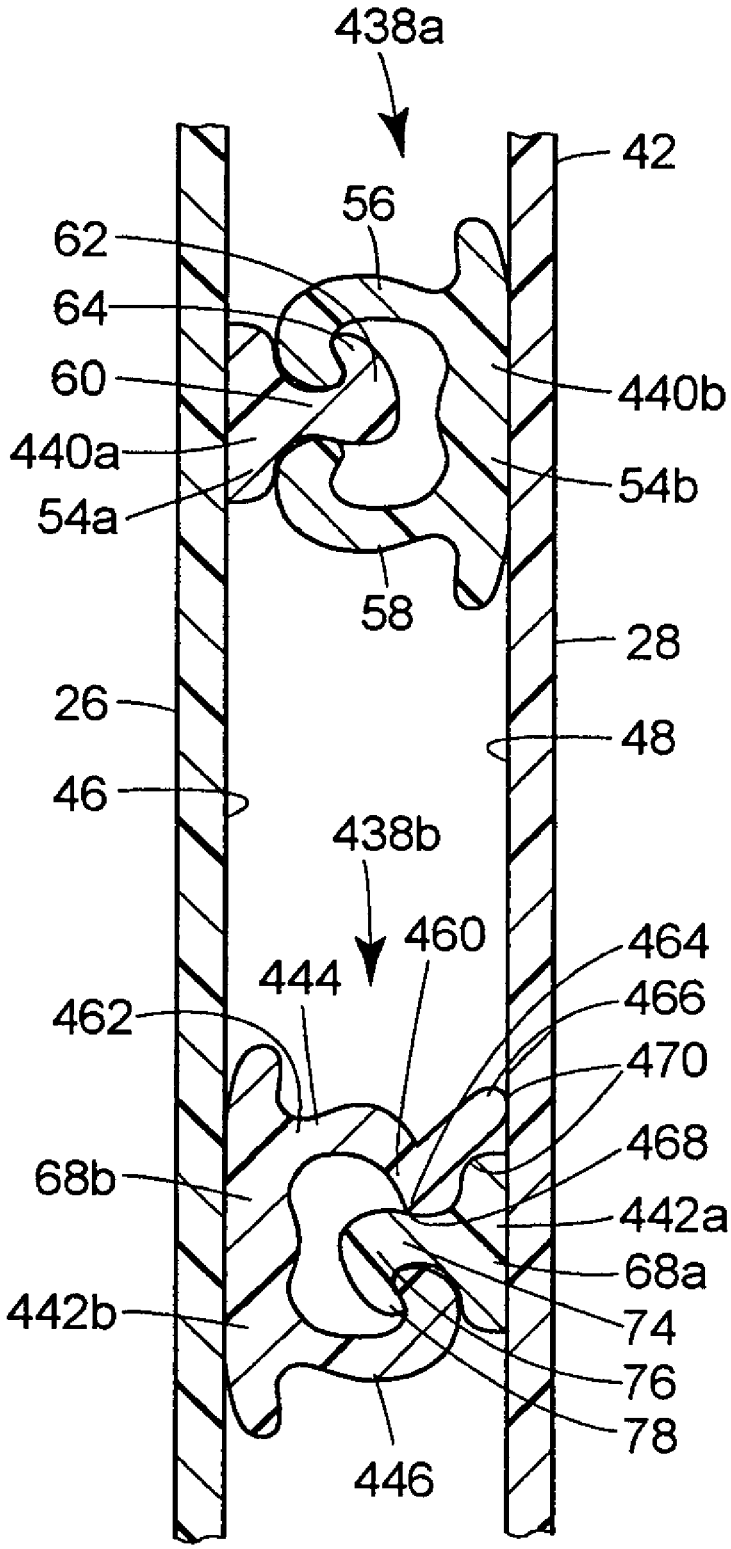

The longer spaced leg 444 of FIG. 7 comprises an extension 450. The extension 450 extends from the base 68*b* that is attached to the internal side 46 of the first pouch wall 26 toward the internal side 48 of the second pouch wall 28. The extension 450 includes a proximal portion 452 adjacent the base 68*b* and a distal portion 454 that abuts the base 68*a* of the second male closure element 442*b* and/or a proximal portion 456 of the body 74 when the male and female closure elements 442*a*, 442*b* are engaged with one another. When pressure is applied from internal opening forces, the distal portion 454 of the extension 450 creates a contact point 458 against the base 68*a* and/or the proximal portion 456 of the body 74. FIG. 8 shows another embodiment of the present invention similar to the embodiment of FIG. 7. Instead of an extension 450, the third spaced leg 444 includes a wedge portion 460. The wedge portion 460 extends from the base 68*b* toward the second pouch wall 28. The wedge portion includes a proximal portion 462, a medial portion 464 and a distal portion 466. The proximal portion 462 of the wedge portion 460 is adjacent the base 68*b*, while the distal portion 466 is closest to the second pouch wall 28. The medial portion 464 is disposed between the proximal portion 462 and the distal portion 466 and extends closer to the bottom portion 34 of the pouch 20 than the proximal and distal portions 462, 466. The medial portion 464 defines a trough or wedge shape. When pressure is applied from internal opening forces, the medial portion 464 creates a contact point 468 against the body 74 and the distal portion creates a contact point 470 against the base 68*a* of the second male closure element 442*a* and/or the internal side 48 of the opposing pouch wall 28. By increasing the length and/or shape of the legs of the second female closure elements 442*b*, an increase in the amount of force and/or flexure may be needed to open the second closure mechanism 438*b* of some embodiments.

Figure 9:
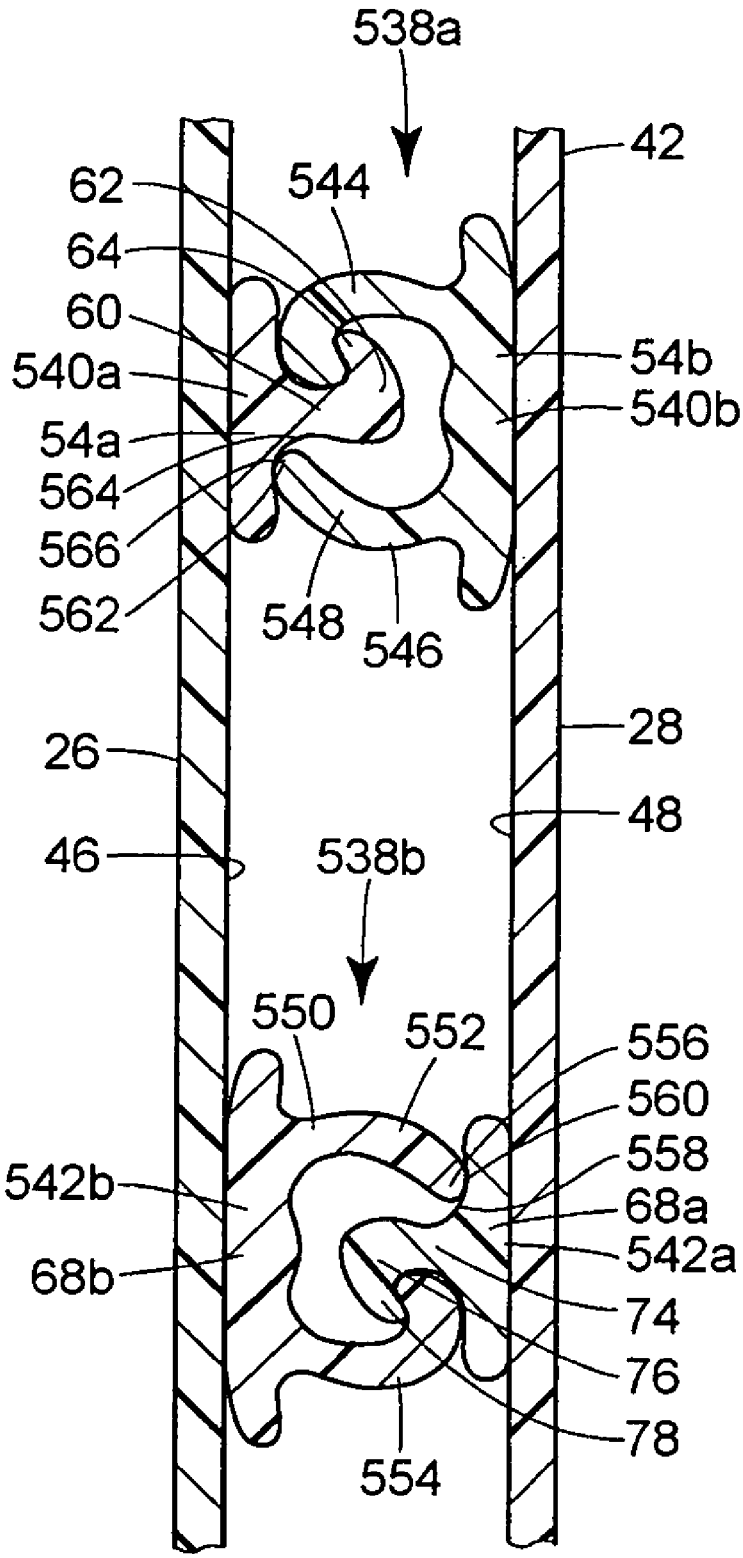

In a different embodiment of the present invention, two or more female closure elements include a longer spaced leg, such as the longer legs of FIGS. 7 and 8. Some of these embodiments include longer legs disposed in opposing directions, wherein one leg increases the internal opening force of a closure mechanism while the other longer leg increases the external opening force of a different closure mechanism. Indeed, some embodiments include female closure elements with both spaced legs being longer to provide for an overall increase in the external and internal opening forces required to open the closure mechanism. For example, FIG. 9 shows an embodiment that utilizes two longer spaced legs. A first closure mechanism 538*a* comprises a first male closure element 540*a* and a first female closure element 540*b*, wherein the male closure element 540*a*, which is similar to the asymmetrical male closure elements described above, has the first hook portion 64 extending toward the upper edge 42 of the pouch 20. A second closure mechanism 538*b* comprises a second male closure element 542*a* and a second female closure element 542*b*, wherein the second male closure element 542*b* has the second hook portion 78 extending toward the bottom portion 34 of the pouch 20 in the opposite direction of the first hook portion 64. The first female closure element 540*b* includes a first spaced leg 544 and a second longer spaced leg 546 that includes an extension 548, wherein the first spaced leg 544 is closer to the upper edge 42 than the extension 548. The second female closure element 542*b* includes a third longer spaced leg 550 that includes an extension 552 and a fourth spaced leg 554, wherein the third longer spaced leg 550 is closer to the upper edge 42 than the extension 552. The extension 548 of the first female closure element 540*b* provides additional resistance against external opening forces, while the extension 552 of the second female closure element 542*b* provides additional resistance against internal opening forces. Specifically, when an internal opening force is exerted on the pouch 20, a distal portion 556 of the extension 552 abuts the base 68*a* of the second male closure element 542*a* and/or a proximal portion 558 of the body 74 to create a contact point 560. When an external opening force is applied to the pouch 20, a distal portion 562 of the extension 548 abuts the base 54*a* of the first male closure element 540*a* and/or a proximal portion 564 of the body 60 to create a contact point 566.

Figure 10:
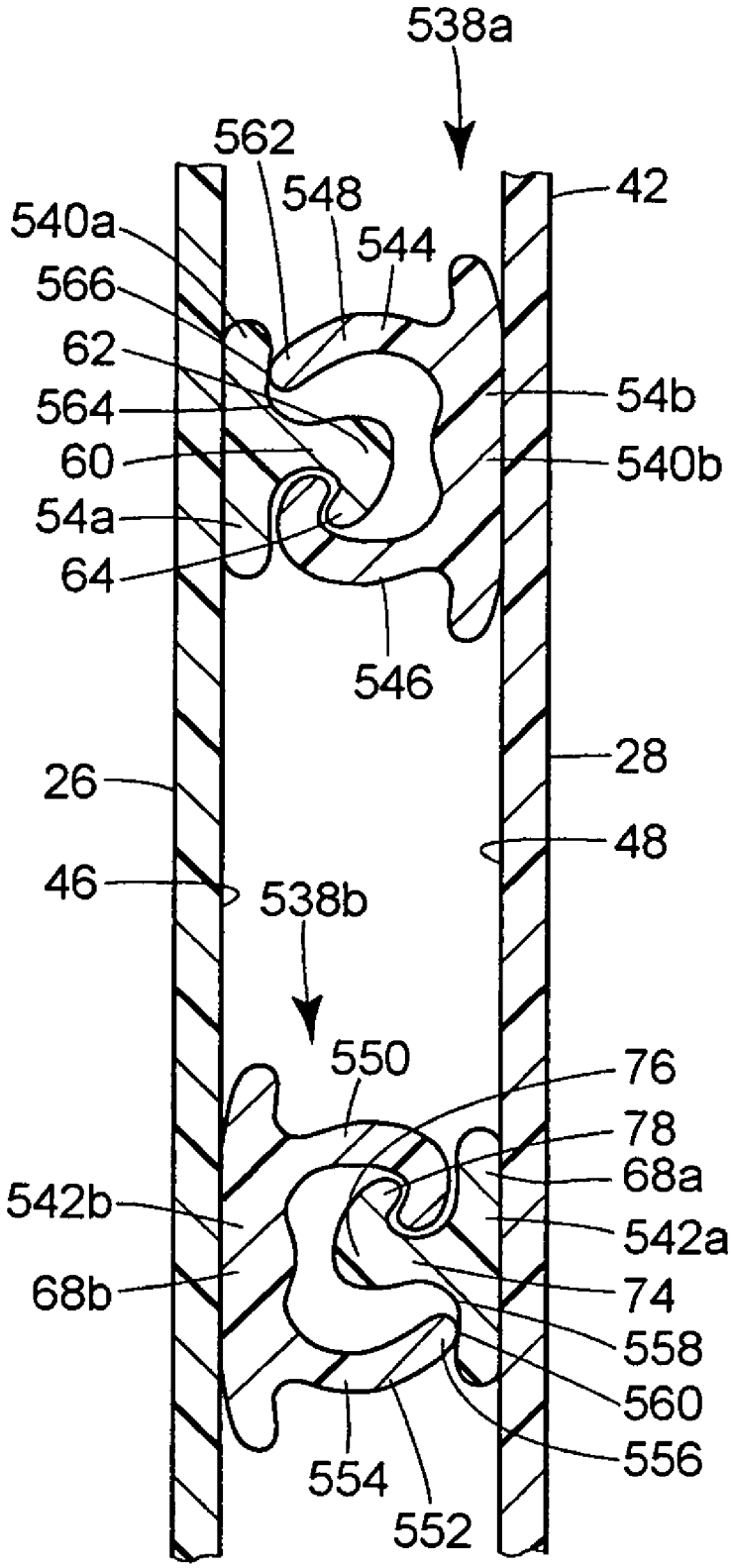

FIG. 10 depicts a similar embodiment to that shown in FIG. 9. However, instead of the first hook portion 64 being directed toward the upper edge 42, the first hook portion 64 is directed toward the bottom portion 34 of the pouch 20. Also, the second hook portion 78 is directed toward the upper edge 42. The first leg 544 has the extension 548 as opposed to the second spaced leg 546, and the fourth spaced leg 554 has the extension 552 as opposed to the third spaced leg 550. Therefore, the extension 548 of the first female closure element 540*b* provides for additional resistance against internal opening forces, while the extension 552 of the second female closure element 542*b* provides for additional resistance against external opening forces.

Figure 11:
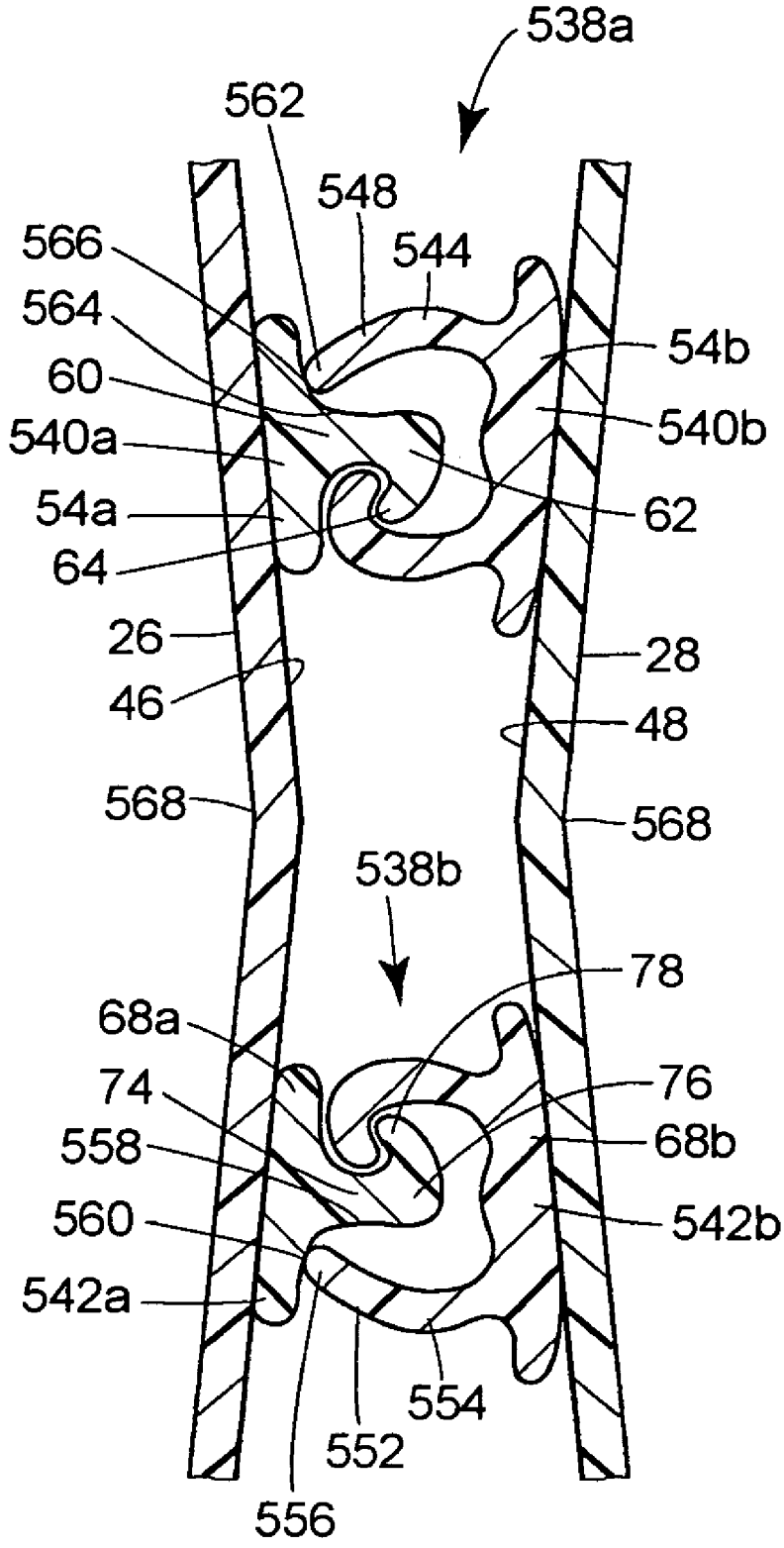

FIG. 11 shows yet another embodiment of the present invention. In this embodiment, both the first and second female closure elements 540*b*, 542*b* are disposed on the second pouch wall 28, while the first and second male closure elements 540*a*, 540*b* are disposed on the first pouch wall 26. Also, the lengths of the extensions 548, 552 have been selected to be sufficiently long enough to press against the opposing first side pouch wall 26. Because the first leg 544 and the fourth leg 554 have increased lengths, the first and second pouch walls 26, 28 are pushed outwardly at areas above the first spaced leg 544 (toward the upper edge 42) and below the fourth spaced legs 554 (toward the bottom portion 34). The engagement of the legs 544 and 554 with the first pouch wall 26 also forces the first and second pouch walls 26, 28 inwardly at an area below the first leg 544 and above the fourth leg 554. A channel 568 is therefore created between the first and fourth legs 544, 554. Similar to the embodiment depicted in FIG. 6, the channel 568 may be used to guide the user's fingers during closure of the pouch 20.

It should be readily apparent to those skilled in the art that numerous combinations of symmetric and asymmetric male and female closure elements are possible to create pouches with a multitude of differing opening and closing forces. The number of closure mechanisms and the order and placement on the pouch walls may be varied to adjust the opening and closing characteristics of the pouch. Additionally, it is envisioned that various other closure characteristics, such as tactile feedback, aural feedback, etc., can be used in conjunction with the aforementioned embodiments of the present invention.

In any of the embodiments illustrated in FIGS. 3-6, a pouch may include at least three closure mechanisms that are adjacent each other but spaced from one another by a distance that is sufficiently small to create the perception that the mechanisms act as a single closure. In addition, the closure mechanisms are preferably disposed sufficiently far apart such that a user's finger(s) and/or thumb are guided during the closing operation. Similar to the dual closure mechanism embodiments above, these results are accomplished by spacing adjacent closure mechanisms between about 0.05 inch (1.27 mm) and 0.15 inch (3.81 mm) apart, and, more preferably, between about 0.08 inch (2.03 mm) and about 0.12 inch (3.05 mm) apart and most preferably about 0.1 inch (2.54 mm) apart, although different spacing may instead be used.

For example, in the embodiment depicted in FIG. 4, the first closure mechanism 138*a* is adjacent the second closure mechanism 138*b* but is spaced a first distance therefrom. The second closure mechanism 138*b* is adjacent the third closure mechanism 138*c* but is spaced a second distance therefrom. The third closure mechanism 138*c* is adjacent the fourth closure mechanism 138*d* but is spaced a third distance therefrom. When the pouch 20 is closed, none of the closure mechanisms contact one another. In addition, no closure elements are disposed between adjacent closure mechanisms. In the present example, this means there is no closure element between the first and second closure mechanisms 138*a*, 138*b*, the second and third closure mechanisms 138*b*, 138*c*, and the third and fourth closure mechanisms 138*c*, 138*d*. As noted above, the first, second, and third distances are sufficiently small enough to permit a user to concurrently close the first, second, third, and fourth closure mechanisms. Additionally, the first, second, and third distances are sufficiently large enough to assist in guiding the user during closure of the pouch 20. Other embodiments may utilize three closure mechanisms or more than four. In any embodiment, the distance between adjacent closure mechanisms may be adjusted so long as the aforementioned properties are still evident.

Further, in any of the embodiments depicted in FIGS. 3-6, the multiple closure mechanisms may include differing closure characteristics. For example, the first closure mechanism of FIG. 4 has a first closure characteristic, the second closure mechanisms has a second closure characteristic, the third closure mechanism may has a third closure characteristic, and the fourth closure mechanism has a fourth closure characteristic. In any of the embodiments depicted in FIGS. 3-6, one or more of the first, second, third, and fourth closure mechanisms may have a different closure characteristic than one or more of the remaining closure mechanisms. For example, the first closure characteristic comprises the first closure mechanism having a greater resistance to external opening forces than one or more of the remaining closure mechanisms. In another embodiment, the first closure characteristic comprises the first closure mechanism having a greater resistance to internal opening forces than one or more of the remaining closure mechanisms. In yet another embodiment, the first closure characteristic comprises the first closure mechanism having a greater resistance to closing forces than one or more of the remaining closure mechanisms.

INDUSTRIAL APPLICABILITY

The present invention comprehends multiple closure mechanisms that have opening and closing force characteristics that can permit easy closing of a pouch yet provide a desired level of resistance against external and internal opening forces. Thus, closing and opening is improved and the expenditure of wasted effort by the user is minimized.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A reclosable pouch, comprising:

first and second pouch walls;

first and second closure mechanisms disposed on internal sides of the first and second walls each having a first dimension when closed, the first dimension measured between the internal sides of the first and second walls; and a third closure mechanism disposed between the first and second closure mechanisms on the internal sides of the first and second walls and having a second dimension when closed, the second dimension measured between the internal sides of the first and second walls;

wherein each of the first, second, and third closure mechanisms includes a first C-shaped closure element disposed on one of the first and second walls and a second, complementary closure element having a body and at least one hook extending from an end of the body, the second closure element being disposed on the other of the first and second walls and interlocking with the first closure element;

wherein the first and second dimensions are different such that when the first, second, and third closure mechanisms are closed, a channel is formed by each of the walls between the first and second closure mechanisms.

2. The reclosable pouch of claim 1, wherein the first closure mechanism is spaced a first distance from the third closure mechanism, and wherein the second closure mechanism is spaced a second distance from the third closure mechanism, and wherein the first and second distances are sufficiently small to permit a user to concurrently close the first, second, and third closure mechanisms.

3. The reclosable pouch of claim 1, wherein the first closure mechanism includes a first female closure element having a C-shaped profile that includes first and second spaced legs extending from a first base and a first male closure element that has a first body, wherein the first male closure element includes only a first hook portion that extends from only a first side of the first body at an end thereof to engage one of the first and second spaced legs, the second closure mechanism includes a second female closure element having a C-shaped profile that includes third and fourth spaced legs extending from a second base and a second male closure element that has a second body, wherein the second male closure element includes only a second hook portion that extends from only a first side of the second body at an end thereof to engage one of the third and fourth spaced legs, and the third closure mechanism includes a third female closure element having a C-shaped profile that includes fifth and sixth spaced legs extending from a third base and a third male closure element, wherein the first and second hook portions extend in opposite directions, and wherein distal ends of the first and second spaced legs and the third and fourth spaced legs make contact with the first body and the second body, respectively, when the first and second closure mechanisms are closed.

4. The reclosable pouch of claim 3, wherein at least one of the legs of the first and second, the third and fourth, and the fifth and sixth spaced legs of the first, second, and third female closure elements, respectively, is longer than the other spaced leg of the same female closure element.

5. The reclosable pouch of claim 1, wherein the perceptible verification that the first, second, and third closure mechanisms are closed comprises a channel in at least one of the first and second pouch walls between the first and second closure mechanisms.

6. A reclosable pouch, comprising:

first and second walls;

first, second, and third closure mechanisms each disposed on internal surfaces of the first and second walls, wherein when the pouch is closed, the closure mechanisms do not contact one another, and wherein the first closure mechanism is adjacent the second closure mechanism but is spaced a first distance therefrom, and wherein the second closure mechanism is adjacent the third closure mechanism but is spaced therefrom a second distance, and wherein no closure element is disposed between the first and second closure mechanisms and no closure element is disposed between the second and third closure mechanisms;

wherein the first and second distances are sufficiently small to permit a user to concurrently close the first, second, and third closure mechanisms and wherein the first and second distances are sufficiently large to assist in guiding a user during closure of the pouch; and wherein each of the first, second, and third closure mechanisms includes a female closure element having a C-shaped profile that includes first and second spaced legs extending from a base and a male closure element that has a body and at least one hook portion that extends from the body at an end thereof such that the at least one hook portion of each closure mechanism interacts with a respective C-shaped profile; and wherein the first and third closure mechanisms each have a first dimension when closed, the second closure mechanism has a second dimension when closed, the first and second dimensions are measured between the internal sides of the first and second walls, and the second dimension is smaller than the first dimension such that when the first, second, and third closure mechanisms are closed, a channel is formed by each of the walls between the first and third closure mechanisms.

7. The reclosable pouch of claim 6, wherein the first and second distances are in a range of about 0.05 in. to about 0.15 in.

8. The reclosable pouch of claim 6, wherein the first and second distances are in a range of about 0.08 in. to about 0.12 in.

9. The reclosable pouch of claim 6, wherein the first and second distances are about 0. 1 in.

10. The reclosable pouch of claim 6, wherein a fourth closure mechanism is disposed adjacent the third closure mechanism but is spaced a third distance therefrom, and wherein no closure element is disposed between the third and fourth closure mechanisms, and wherein the third distance is sufficiently small to permit a user to concurrently close the first, second, third and fourth closure mechanisms, while also being sufficiently large to assist in guiding the user during closure of the pouch.

11. The reclosable pouch of claim 6, wherein the first closure mechanism has a first closure characteristic, the second closure mechanism has a second closure characteristic, and the third closure mechanism has a third closure characteristic.

12. The reclosable pouch of claim 11, wherein one of the first, second, or third closure characteristics is different than one of the remaining first, second, or third closure characteristics.

13. The reclosable pouch of claim 11, wherein the first closure characteristic comprises the first closure mechanism having a greater resistance to external opening forces than one of the second or third closure mechanisms.

14. The reclosable pouch of claim 11, wherein the first closure characteristic comprises the first closure mechanism having a greater resistance to internal opening forces than one of the second or third closure mechanisms.

15. The reclosable pouch of claim 11, wherein the first closure characteristic comprises the first closure mechanism having a greater resistance to closing forces than one of the second of third closure mechanisms.

16. The reclosable pouch of claim 6, wherein the female closure elements of at least two of the first, second, and third closure mechanisms are disposed on opposite internal sides of first and second pouch walls.

17. A reclosable pouch, comprising:

a body portion having first and second pouch walls;

a first closure mechanism disposed on internal sides of the first and second walls adjacent a mouth of the pouch and including a first female closure element having a C-shaped profile that includes first and second spaced legs extending from a first base and a first male closure element that has a first body, wherein the first male closure element includes only a first hook portion that extends from only a first side of the first body at an end thereof to engage one of the first or second spaced legs;

a second closure mechanism disposed on the internal sides of the first and second walls between the first closure mechanism and a bottom portion of the pouch and including a second female closure element having a C-shaped profile that includes third and fourth spaced legs extending from a second base and a second male closure element that has a second body, wherein the second male closure element includes only a second hook portion that extends from only a first side of the second body at an end thereof to engage one of the third or fourth spaced legs; and a third closure mechanism disposed on the internal sides of the first and second walls between the first and second closure mechanisms and including a third female closure element having a C-shaped profile that includes fifth and sixth spaced legs extending from a third base and a third male closure element;

wherein the first and second male closure element hook portions extend in opposite directions, and wherein distal ends of the first and second spaced legs and the third and fourth spaced legs make contact with the first body and the second body, respectively, when the first and second closure mechanisms are closed; and wherein the first and second closure mechanisms each have a first dimension when closed, the third closure mechanism has a second dimension when closed, the first and second dimensions are measured between the internal sides of the first and second walls, and the second dimension is smaller than the first dimension such that when the first, second, and third closure mechanisms are closed, a channel is formed by each of the walls between the first and second closure mechanisms.

18. The reclosable pouch of claim 17, wherein the third male closure element includes two hook portions extending from an end thereof to engage the legs of the third female closure element.

19. The reclosable pouch of claim 17, wherein a fourth closure mechanism is disposed on internal sides of the first and second pouch walls, and wherein the fourth closure mechanism includes a fourth female closure element having seventh and eighth spaced legs and a fourth male closure element.

20. The reclosable pouch of claim 19, wherein the fourth closure mechanism is disposed between the first closure mechanism and the mouth of the pouch, the first closure mechanism is disposed between the fourth closure mechanism and the third closure mechanism, the third closure mechanism is disposed between the first closure mechanism and the second closure mechanism, and the second closure mechanism is disposed between the bottom portion of the pouch and the third closure mechanism.

21. The reclosable pouch of claim 20, wherein the first, second, and third male closure elements comprise only one hook portion extending from an end thereof to engage the first, second, and third female closure elements, respectively, and the fourth male closure element comprises two hooks extending from an end thereof.

22. The reclosable pouch of claim 21, wherein the first, second, and third male closure element hook portions are oriented to extend from the respective closure element ends in the same manner.

23. The reclosable pouch of claim 20, wherein the first, second, third, and fourth male closure elements comprise only one hook portion extending from an end thereof to engage the first, second, third, and fourth female closure elements, respectively.

24. The reclosable pouch of claim 23, wherein the first, second, and third male closure element hook portions are oriented to extend from the respective closure element ends in the same manner.

25. The reclosable pouch of claim 24, wherein the first, second, and third hook portions extend toward the bottom portion of the pouch, and wherein the fourth hook portion extends toward the mouth of the pouch.

26. The reclosable pouch of claim 17, wherein the first female closure element is disposed on the internal side of the first wall and the second female closure element is disposed on the internal side of the second wall.

* * * * *